US008681142B2

(12) United States Patent
Bo-Yong

(10) Patent No.: US 8,681,142 B2
(45) Date of Patent: Mar. 25, 2014

(54) SCAN DRIVER AND FLAT PANEL DISPLAY APPARATUS INCLUDING THE SAME

(75) Inventor: Chung Bo-Yong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 848 days.

(21) Appl. No.: 12/871,721

(22) Filed: Aug. 30, 2010

(65) Prior Publication Data

US 2011/0187691 A1 Aug. 4, 2011

(30) Foreign Application Priority Data

Feb. 4, 2010 (KR) ..... 10-2010-0010493

(51) Int. Cl.
*G09G 5/00* (2006.01)
*G09G 3/36* (2006.01)

(52) U.S. Cl.
USPC ..... 345/211; 345/204; 345/100

(58) Field of Classification Search
USPC ..... 345/204, 211, 690, 55, 100, 98, 99, 345/559; 377/64, 73, 79, 81; 327/241, 199, 327/225, 108, 295, 298, 299, 109; 340/12.21; 365/78; 330/282, 291
See application file for complete search history.

(56) References Cited

U.S. PATENT DOCUMENTS

2005/0264496 A1* 12/2005 Shin ..... 345/76
2006/0152459 A1 7/2006 Shin
2008/0100560 A1* 5/2008 Na et al. ..... 345/101
2009/0262058 A1* 10/2009 Pak et al. ..... 345/92

FOREIGN PATENT DOCUMENTS

KR 10-2005-0037657 A 4/2005
KR 10-2006-0000317 A 1/2006
KR 10-2006-0059082 A 6/2006
KR 10-2006-0059094 A 6/2006

OTHER PUBLICATIONS

KIPO Registration Determination Certificate dated Dec. 5, 2011 for KR 10-2010-0010493 (5 pages).

* cited by examiner

*Primary Examiner* — Kent Chang
*Assistant Examiner* — Nelson Rosario
(74) *Attorney, Agent, or Firm* — Christie, Parker & Hale, LLP

(57) ABSTRACT

A scan driver and a flat panel display apparatus including the scan driver. The scan driver includes a plurality of scan stages, wherein two transistors are coupled between each scan stage such that the scan driver is capable of performing progressive scanning or interlaced scanning.

29 Claims, 11 Drawing Sheets

SCAN DRIVER AND FLAT PANEL DISPLAY APPARATUS INCLUDING THE SAME

CROSS-REFERENCE TO RELATED APPLICATION

This application claims priority to and the benefit of Korean Patent Application No. 10-2010-0010493, filed on Feb. 4, 2010, in the Korean Intellectual Property Office, the disclosure of which is incorporated herein in its entirety by reference.

BACKGROUND

1. Field

Aspects of embodiments of the present invention relate to a scan driver and a flat panel display apparatus including the same.

2. Description of Related Art

A flat panel display apparatus, such as a liquid crystal display (LCD) or an organic light emitting diode (OLED) display, displays a desired image in accordance with data applied to a plurality of pixels that are arranged in a matrix in a display unit.

In order to drive a plurality of pixels, a scan driver selects a pixel to be applied with data located in a selected row among rows of the pixels. In other words, the scan driver applies a scan signal to a scanning line (i.e., the selected row), and applies desired data to a pixel that receives the scan signal. Here, examples of a method of supplying the scan signal to the scanning line may include a progressive scanning method and an interlaced scanning method.

In the progressive scanning method, a scan signal is sequentially supplied to scanning lines forming a panel. In other words, the scan signal is sequentially supplied from a first scanning line to a last scanning line.

In the interlaced scanning method, a scan signal is sequentially supplied in two cycles over one frame. In other words, the scan signal is sequentially supplied only to odd scanning lines first, and then the scan signal is sequentially supplied only to even scanning lines.

The progressive scanning method and the interlaced scanning method have different orders of applying a scan signal to scanning lines. Accordingly, while manufacturing a flat panel display apparatus, a scanning method to be used is predetermined, and a scan driver that is operated according to the predetermined scanning method is provided. When two scanning methods are to be used, two scan drivers are provided.

SUMMARY

Aspects of embodiments of the present invention are directed toward a scan driver capable of performing progressive scanning and interlaced scanning, and a flat panel display apparatus including the scan driver.

According to an embodiment of the present invention, a scan driver includes: a plurality of scan stages, each of the scan stages for generating an output signal according to a clock signal and an input signal; and a plurality of input signal select circuits, at least one of the input signal select circuits for selecting the output signal of one of the scan stages from one stage before or the output signal of another one of the scan stages from two stages before, according to a mode select signal, wherein the mode select signal includes a first mode signal and a second mode signal, and the at least one of the plurality of input signal select circuits includes: a first transistor coupled between an output terminal of the one of the scan stages from one stage before and an input terminal of a current one of the scan stages, and being configured to perform a switching operation according to the first mode signal; and a second transistor coupled between an output terminal of the another one of the scan stages from two stages before and the input terminal of the current one of the scan stages, and being configured to perform a switching operation according to the second mode signal.

Logic levels of the first and second mode signals may be different from each other. Channel types of the first transistor and the second transistor may be different from each other.

The first mode signal and the second mode signal may be the same. Channel types of the first transistor and the second transistor may be the same.

During a progressive scanning operation, the first transistor may be turned on and the second transistor may be turned off.

During an interlaced scanning operation, the first transistor may be turned off and the second transistor may be turned on.

Each of the plurality of scan stages may sample the input signal at a falling edge of the clock signal and outputs the sampled input signal as the output signal at a rising edge of the clock signal.

Each of the plurality of scan stages may include a flip-flop having a master-slave structure.

The output signal may be output for one cycle of the clock signal.

Each of the plurality of scan stages may include: a first signal processor for generating a first output signal in response to receiving the clock signal, the input signal, and an inverse input signal; a second signal processor for generating a second output signal in response to receiving the first output signal, an inverse clock signal, and a first negative feedback signal; a third signal processor for generating a third output signal in response to receiving the second output signal; a fourth signal processor for generating a fourth output signal in response to receiving the second output signal, the third output signal, and the inverse clock signal; a fifth signal processor for generating a fifth output signal in response to receiving the fourth output signal, the clock signal, and a second negative feedback signal; and a sixth signal processor for generating the output signal in response to receiving the fifth output signal.

The first negative feedback signal may be the third output signal, and the second negative feedback signal may be the output signal.

The fifth output signal may be an inverse output signal of a corresponding one of the scan stages.

The first signal processor may include: a first transistor for switching a first power voltage according to the clock signal; a second transistor for supplying the first power voltage from the first transistor as the first output signal when the input signal is applied to a control terminal of the second transistor; a third transistor for blocking a second power voltage from being supplied as the first output signal when the input signal is applied to a control terminal of the third transistor; a first capacitor having a first terminal coupled to a first terminal of the third transistor, and a second terminal coupled to a second terminal of the third transistor; a fourth transistor for supplying the second power voltage as the first output signal, a control terminal of the fourth transistor being coupled to the first terminal of the third transistor; a fifth transistor for transferring the second power voltage to the control terminal of the fourth transistor when the inverse input signal is applied to a control terminal of the fifth transistor; and a sixth transistor for transferring the second power voltage to the fourth transistor according to the clock signal.

The second signal processor may include: a seventh transistor for switching a first power voltage according to the inverse clock signal; an eighth transistor for supplying the first power voltage from the seventh transistor as the second output signal when the first negative feedback signal is applied to a control terminal of the eighth transistor; a ninth transistor for blocking a second power voltage from being supplied as the second output signal when the first negative feedback signal is applied to a control terminal of the ninth transistor; a second capacitor having a first terminal coupled to a first terminal of the ninth transistor, and a second terminal coupled to a second terminal of the ninth transistor; a tenth transistor for supplying the second power voltage as the second output signal, a first terminal of the tenth transistor being coupled to the first terminal of the ninth transistor; an eleventh transistor for transferring the second power voltage to a control terminal of the tenth transistor when the first output signal is applied to a control terminal of the eleventh transistor; and a twelfth transistor for transferring the second power voltage to the tenth transistor according to the inverse clock signal.

The third signal processor may include: a thirteenth transistor for switching a first power voltage according to the second output signal; a fourteenth transistor for receiving a second power voltage and supplying the received second power voltage as the third output signal; a third capacitor having a first terminal coupled to a control terminal of an eighth transistor and a control terminal of a ninth transistor, and a second terminal coupled to a control terminal of the fourteenth transistor; and a fifteenth transistor having a control terminal to which the second power voltage is applied, and for transferring the second power voltage to the fourteenth transistor.

The fourth signal processor may include: a sixteenth transistor for switching a first power voltage according to the inverse clock signal; a seventeenth transistor for supplying the first power voltage from the sixteenth transistor as the fourth output signal when the third output signal is applied to a control terminal of the seventeenth transistor; an eighteenth transistor for blocking a second power voltage from being supplied as the fourth output signal when the third output signal is applied to a control terminal of the eighteenth transistor; a fourth capacitor having a first terminal coupled to a first terminal of the eighteenth transistor and a second terminal coupled to a second terminal of the eighteenth transistor; a nineteenth transistor for supplying the second power voltage as the fourth output signal, a control terminal of the nineteenth transistor being coupled to the first terminal of the eighteenth transistor; a twentieth transistor for transferring the second power voltage to the control terminal of the nineteenth transistor when the second output signal is applied to a control terminal of the twentieth transistor; and a twenty-first transistor for transferring the second power voltage to the nineteenth transistor according to the inverse clock signal.

The fifth signal processor may include: a twenty-second transistor for switching a first power voltage according to the clock signal; a twenty-third transistor for transferring the first power voltage to a twenty-fifth transistor when the second negative feedback signal is applied to a control terminal of the twenty-third transistor; a twenty-fourth transistor having a control terminal to which the second negative feedback signal is applied, and being configured to diode-connect the twenty-fifth transistor; a fifth capacitor having a first terminal coupled to a first terminal of the twenty-fourth transistor, and a second terminal coupled to a second terminal of the twenty-fourth transistor; a twenty-fifth transistor having a first terminal coupled to the second terminal of the twenty-fourth transistor, and a control terminal coupled to the first terminal of the twenty-fourth transistor; a twenty-sixth transistor for transferring a second power voltage to the control terminal of the twenty-fifth transistor when the fourth output signal is applied to a control terminal of the twenty-sixth transistor; and a twenty-seventh transistor for transferring the second power voltage to the twenty-fifth transistor according to the clock signal.

The sixth signal processor may include: a twenty-eighth transistor for switching a first power voltage according to the fifth output signal; a twenty-ninth transistor for receiving a second power voltage and supplying the received second power voltage as the output signal; a sixth capacitor having a first terminal coupled to a control terminal of a twenty-third transistor and a control terminal of a twenty-fourth transistor, and a second terminal coupled to a control terminal of the twenty-ninth transistor; and a thirtieth transistor having a control terminal to which the second power voltage is applied, and for transferring the second power voltage to the twenty-ninth transistor.

According to another embodiment of the present invention, a flat panel display apparatus includes: a scan driver for supplying a scan signal to a plurality of scanning lines; a data driver for supplying a data signal to a plurality of data lines; a signal generator for generating a clock signal and a mode select signal, and applying the generated clock signal and mode select signal to the scan driver; and a display unit including a plurality of pixel circuits at crossing regions between the plurality of scanning lines and the plurality of data lines, wherein the scan driver includes: a plurality of scan stages, each of the scan stages for generating an output signal according to the clock signal and an input signal; and a plurality of input signal select circuits, at least one of the input signal select circuits for selecting one signal from the output signal of one of the scan stages from one stage before or the output signal of another one of the scan stages from two stages before, according to the mode select signal.

The flat panel display apparatus may further include a controller for controlling the signal generator so that the flat panel display apparatus is operated according to a progressive scanning method or an interlaced scanning method.

The mode select signal may include a first mode signal and a second mode signal, and the at least one of the plurality of input signal select circuits may include: a first transistor coupled between the output terminal of the one of the scan stages from one stage before and an input terminal of a current one of the scan stages, and being configured to perform a switching operation according to the first mode signal; and a second transistor coupled between the output terminal of the another one of the scan stages from two stages before and the input terminal of the current one of the scan stages, and being configured to perform a switching operation according to the second mode signal.

Logic levels of the first mode signal and the second mode signal may be different from each other. Channel types of the first transistor and the second transistor may be different from each other.

The first mode signal and the second mode signal may be the same. Channel types of the first transistor and the second transistor may be the same.

During a progressive scanning operation, the first transistor may be turned on and the second transistor may be turned off.

During an interlaced scanning operation, the first transistor may be turned off and the second transistor may be turned on.

The flat panel display apparatus may be an organic light emitting display apparatus.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Hereinafter, the present invention will be described more fully with reference to the accompanying drawings, in which exemplary embodiments of the invention are shown. Here, when a first element is described as being connected to or coupled to a second element, the first element may be directly connected to or coupled to the second element or indirectly connected to or coupled to the second element via a third element.

Figure 1:
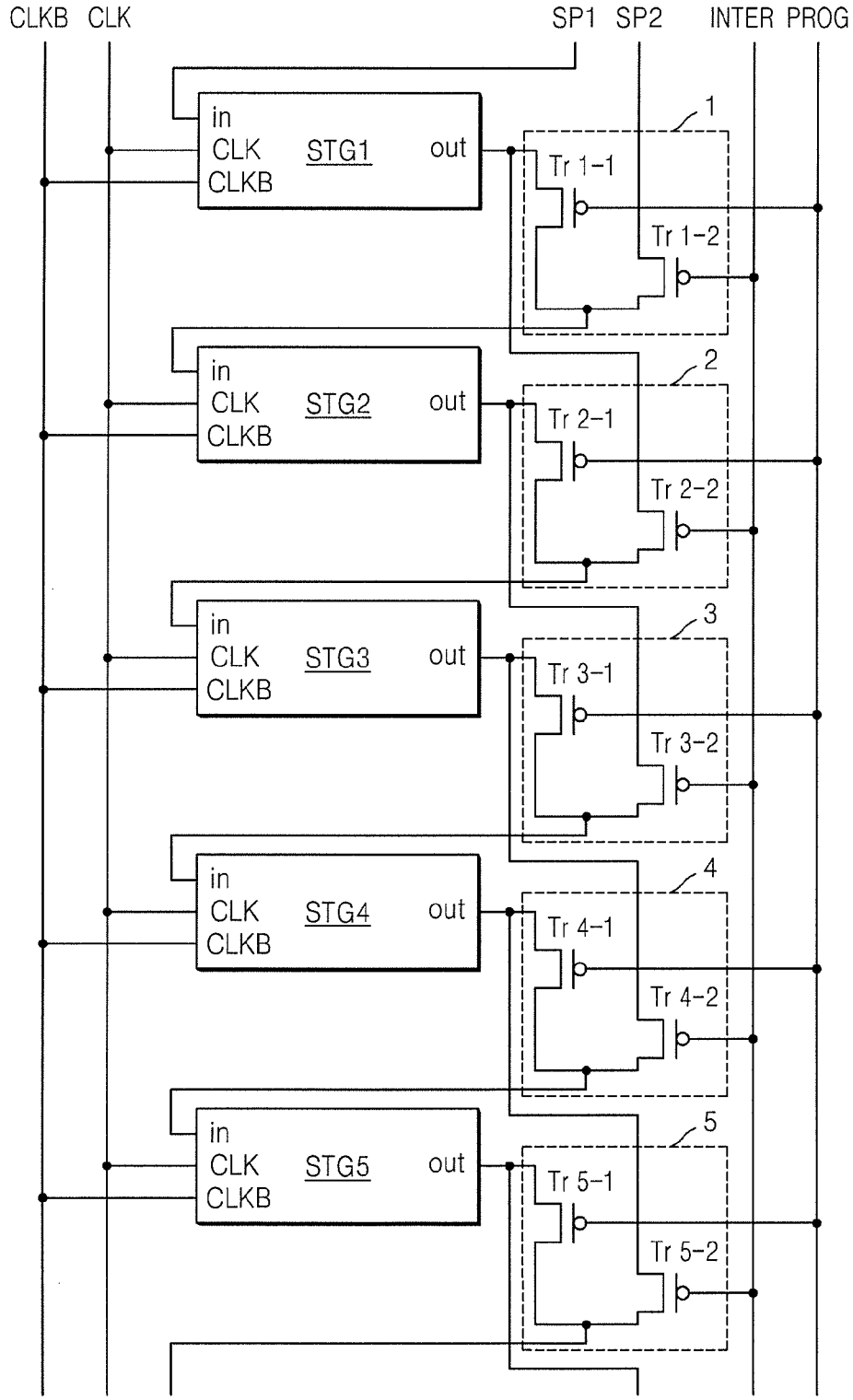
FIG. 1 is a circuit diagram of a scan driver for both progressive scanning and interlaced scanning, according to an embodiment of the present invention.

FIG. 1 is a circuit diagram of a scan driver for both progressive scanning and interlaced scanning, according to an embodiment of the present invention.

Referring to FIG. 1, the scan driver according to an embodiment of the present invention includes a plurality of scan stages STG1 through STGn, a plurality of input signal select circuits 1 through n-1, and a plurality of signal lines to which various control signals are applied.

Each of the scan stages STG1 through STGn includes a clock signal input terminal to which a clock signal CLK is applied, an inverse clock signal input terminal to which an inverse clock signal CLKB is applied, an input signal terminal to which an input signal is applied, and an output signal terminal from which an output signal is output. The clock signal CLK is applied to the clock signal input terminal via a clock signal line that is connected to the clock signal input terminal.

Each of the scan stages STG1 through STGn generates an output signal according to the applied clock signal CLK, inverse clock signal CLKB, and input signal, and includes a circuit having a master-slave structure. Examples of such a circuit include a flip-flop. A circuit structure of each of the scan stages STG1 through STGn will be described in more detail below.

The output signal generated by each of the scan stages STG1 through STGn is a scan signal that is supplied to each pixel circuit via a scanning line formed in a flat panel display apparatus.

The number of scan stages is determined based on a number of pixels in a vertical direction (or scanning direction), i.e., the number of scanning lines formed in the flat panel display apparatus. In one embodiment of the present invention, n scanning lines are formed in the flat panel display apparatus, and n scan stages, from a first scan stage STG1 through an $n^{th}$ scan stage STGn, are included in the scan driver.

An $a^{th}$ scan stage STGa located at an $a^{th}$ stage selects an output signal of an $a-1^{th}$ scan stage STGa−1 from one stage before or an output signal of an $a-2^{th}$ scan stage STGa−2 from two stages before, as an input signal. In more detail, the $a^{th}$ scan stage STGa selects the output signal of the $a-1^{th}$ scan stage STGa−1 as the input signal (in) a progressive scanning method, and selects the output signal of the $a-2^{th}$ scan stage STGa−2 as the input signal (in) an interlaced scanning method.

A first scan start signal SP1 for starting scanning may be applied as an input signal to the first scan stage STG1, which is a first scan stage. The first scan start signal SP1 may be periodically generated at each frame, and applied to an input terminal of the first scan stage STG1. Alternatively, the first scan start signal SP1 may be applied once to the first scan stage STG1 when an image display begins, and then an output signal of the $n^{th}$ scan stage STGn that is a last stage may be applied to the first scan stage STG1.

An output signal of the $a^{th}$ scan stage STGa is applied to an $a^{th}$ input signal select circuit (a) connected between the $a^{th}$ scan stage STGa and the $a+1^{th}$ scan stage STGa+1, and an $a+1^{th}$ input signal select circuit a+1 connected between the $a^{th}$ scan stage STGa and the $a+2^{th}$ scan stage STGa+2.

Each of the plurality of input signal select circuits 1 through n-1 selects the output signal generated in a scan stage from one stage before or the output signal generated in a scan stage from two stages before, from among the plurality of scan stages STG1 through STGn. In other words, each of the input signal select circuits 1 through n-1 performs functions of a multiplexer. The selecting of an output signal is performed according to a mode select signal applied from a mode signal line. Here, the mode select signal includes a first mode signal PROG for selecting a progressive scanning method and a second mode signal INTER for selecting an interlaced scanning method.

In the embodiment of FIG. 1, each of the input signal select circuits 1 through n-1 includes two transistors. For example, in the $a^{th}$ input signal select circuit (a), a first transistor Tra-1 has a first terminal connected to an output terminal of the $a^{th}$ scan stage STGa, i.e., a scan stage from one stage before, and a second terminal connected to an input terminal of the $a+1^{th}$ scan stage STGa+2, i.e., a current scan stage. The first mode signal PROG is applied to a gate terminal of the first transistor Tra-1. The first transistor Tra-1 may be a PMOS transistor, and when the first mode signal PROG is at a low level, the first transistor Tra-1 is turned on. In other words, the first transistor Tra-1 is turned on in the progressive scanning method.

A second transistor Tra-2 has a first terminal connected to an output terminal of an a−1$^{th}$ scan stage STGa−1 (i.e., a scan stage from two stages before) and a second terminal connected to the input terminal of the a+1$^{th}$ scan stage STGa+1 (i.e., the current scan stage). The second mode signal INTER is applied to a gate terminal of the second transistor Tra-2. The second transistor Tra-2 may be a PMOS transistor having the same channel type as the first transistor Tra-1, and the second transistor Tra-2 is turned on when the second mode signal INTER is at a low level. In other words, the second transistor Tra-2 is turned on in the interlaced scanning method.

According to one embodiment of the present invention, the first transistor Tra-1 and the second transistor Tra-2 have the same channel type, and switching operations of the first transistor Tra-1 and the second transistor Tra-2 are opposite. Accordingly, the first mode signal PROG and the second mode signal INTER are generated to have different logic levels (e.g., opposite levels).

In FIG. 1, the first and second transistors Tra-1 and Tra-2 are both PMOS transistors, but the present invention is not limited thereto. In other words, the first and second transistors Tra-1 and Tra-2 may both be NMOS transistors. In this case, the first and second transistors Tra-1 and Tra-2 respectively select the progressive scanning method and the interlaced scanning method, when the first and second mode signals PROG and INTER are at high levels.

In the first input signal select circuit 1, the output terminal of the first scan stage STG1 is connected to a first terminal of a first transistor Tr1-1. Also, a second scan start signal SP2 may be applied to a first terminal of a second transistor Tr1-2. In the interlaced scanning method, the second scan start signal SP2 may be periodically generated at each frame, and applied to the first terminal of the second transistor Tr1-2. Alternatively, the second scan start signal SP2 may be an output signal of the n-1$^{th}$ scan stage STGn-1, which is the last scan stage, from among odd scan stages, instead of an image signal that is separately generated. In other words, when scanning of odd scanning lines is finished, even scanning lines are scanned by using a scan pulse applied to the last odd scanning line.

The scan driver may include signal lines through which the clock signal CLK, the inverse clock signal CLKB, the first mode signal PROG, the second mode signal INTER, the first scan start signal SP1, and the second scan start signal SP2 are respectively supplied.

Each of the scan stages STG1 through STGn will now be described in more detail below.

Figure 2:
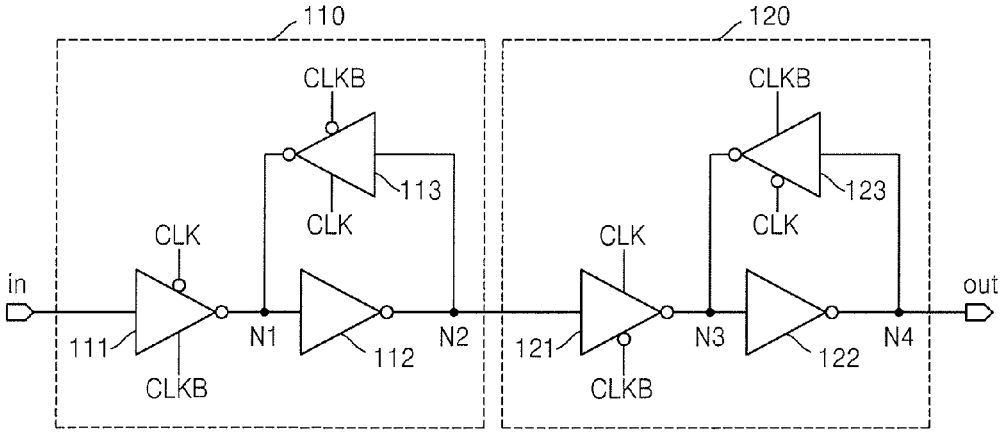
FIG. 2 is a circuit diagram of a scan stage included in the scan driver of FIG. 1, according to an embodiment of the present invention.

FIG. 2 is a circuit diagram of a scan stage included in the scan driver of FIG. 1, according to an embodiment of the present invention.

The scan stage of FIG. 2 is an example of the scan stages STG1 through STGn. The scan stage may include one flip-flop having a master-slave structure. The flip-flop includes two latches, namely, first and second latches 110 and 120, which are connected in series.

The first latch 110 includes a first inverter 111 for sampling an input signal, and second and third inverters 112 and 113 for continuously maintaining a data value sampled by the first inverter 111. The first and third inverters 111 and 113 input or block a signal according to a clock signal CLK.

The first inverter 111 samples the input signal at a falling edge of the clock signal CLK. Accordingly, the input signal is output to an output terminal, i.e., a first node N1 of the first inverter 111 while the clock signal CLK is at a low level. A value obtained by reversing a logic level of the input signal is applied to the first node N1 of the first inverter 111. In other words, when the input signal is at a high level, a low level value is applied to the first node N1, and when the input signal is at a low level, a high level value is applied to the first node N1. A value applied to the first node N1 is again inverted by the second inverter 112, and accordingly, a logic level value identical to the input signal is applied to a second node N2. The sampling of the input signal is blocked according to a rising edge of the clock signal CLK. While the clock signal is at a high level, logic level values applied to the first and second nodes N1 and N2 are maintained by the second and third inverters 112 and 113.

Here, the second latch 120 includes a fourth inverter 121 for sampling an output signal of the first latch 110, and fifth and sixth inverters 112 and 123 for continuously maintaining a data value sampled by the fourth inverter 121. The fourth and sixth inverters 121 and 123 input or block a signal according to the clock signal CLK.

The fourth inverter 121 samples the output signal of the first latch 110 at the rising edge of the clock signal CLK. Accordingly, the output signal of the first latch 110 is output to an output terminal, i.e., a third node N3 of the fourth inverter 121 while the clock signal CLK is at a high level. A value obtained by reversing a logic level of the output signal of the first latch 110 is applied to the third node N3 of the fourth inverter 121. In other words, while the clock signal CLK is at a low level, the second node N2 maintains a value of the input signal and the third node N3 samples the value of the input signal so that the value obtained by reversing the logic level of the input signal is applied to the third node N3. The value applied to the third node N3 is again inverted by the fifth inverter 122, and thus a value having the same logic level as the input signal is applied to a fourth node N4.

Then, the sampling performed by the fourth inverter 121 is blocked at the falling edge of the clock signal CLK, and while the clock signal CLK is at a low level, a logic level value applied to the fourth node N4 is maintained by the fifth and sixth inverters 122 and 123.

The fourth node N4 is connected to an output terminal of the second latch 120, and the output terminal is connected to a scanning line. In other words, an output signal of the second latch 120 is a scan signal.

The scan driver according to one embodiment of the present invention operating according to the progressive scanning method will now be described with reference to FIGS. 1 through 3.

Figure 3:
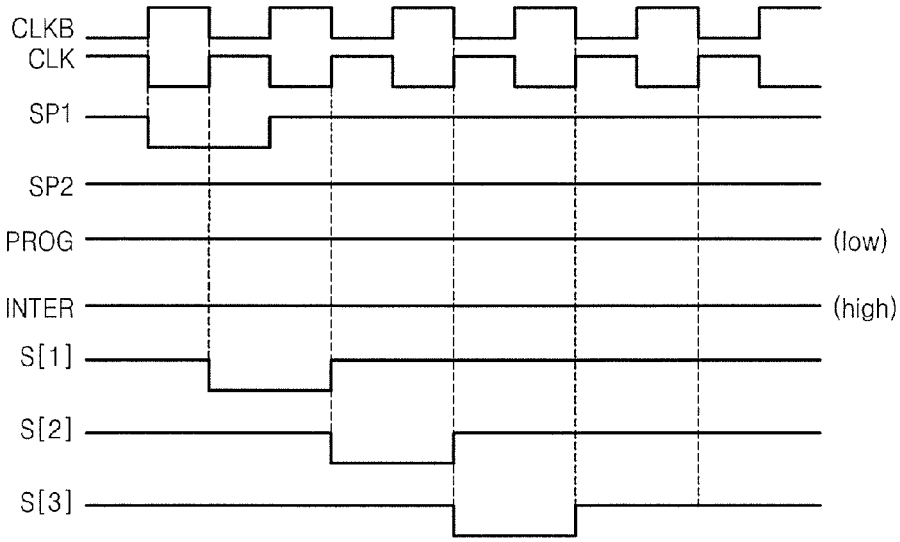
FIG. 3 is a timing diagram for describing a progressive scanning operation of the scan driver of FIG. 1.

FIG. 3 is a timing diagram for describing a progressive scanning operation of the scan driver of FIG. 1, according to an embodiment of the present invention.

In the progressive scanning operation, according to one embodiment, the first mode signal PROG has a low level value, and the second mode signal INTER has a high level value. Accordingly, the first transistors Tr1-1 through Tr(n-1)-1 respectively included in the input signal select circuits 1 through n-1 are turned on, and the second transistors Tr1-2 through Tr(n-1)-2 respectively included in the input signal select circuits 1 through n-1 are turned off. The clock signal CLK and the inverse clock signal CLKB are continuously applied to each of the scan stages STG1 through STGn.

When an operation for displaying an image starts, for example, when the flat panel display apparatus is turned on, the first scan start signal SP1 is applied to the input terminal of the first scan stage STG1. According to one embodiment, the first scan start signal SP1 normally maintains a high level value, but switches to a low level value to start scanning.

The first latch 110 samples the first scan start signal SP1 at the falling edge of the clock signal CLK, and the second latch 120 samples the output signal of the first latch 110 at the rising edge of the clock signal CLK. Here, the output signal of the second latch 120 is an output signal of the first scan stage STG1 and also a scan signal. The first scan start signal SP1 is output as an output signal after being shifted by a half cycle of the clock signal CLK.

The output signal of the first scan stage STG1 is output at the rising edge of the clock signal CLK for a cycle of the clock signal CLK. When the first transistor Tr1-1 of the first input signal select circuit 1 is turned on, the output signal of the first scan stage STG1 is applied to the input terminal of the second scan stage STG2.

The output signal of the first scan stage STG1 is applied to the second scan stage STG2 at the rising edge of the clock signal CLK, but the output signal of the first scan stage STG1 is sampled at the next falling edge of the clock signal CLK and the output signal of the second scan stage STG2 is output at the next rising edge of the clock signal CLK. Accordingly, scan signals are sequentially generated without overlapping between an output signal of a previous scan stage and an output signal of a current scan stage.

By repeating the above processes, the scan driver operates according to the progressive scanning method, wherein a scan signal is sequentially applied to the plurality of scanning lines line by line.

Here, when a scanning operation of one frame is completed, a new first scan start signal SP1 is applied so as to start a scanning operation of a next frame, or the output signal of the $n^{th}$ scan stage STGn (i.e., the last scan stage) is applied to the input terminal of the first scan stage STG1 to start the scanning operation of the next frame.

The scan driver according to one embodiment of the present invention, operating according to the interlaced scanning method, will now be described with reference to FIGS. 1, 2, and 4.

Figure 4:
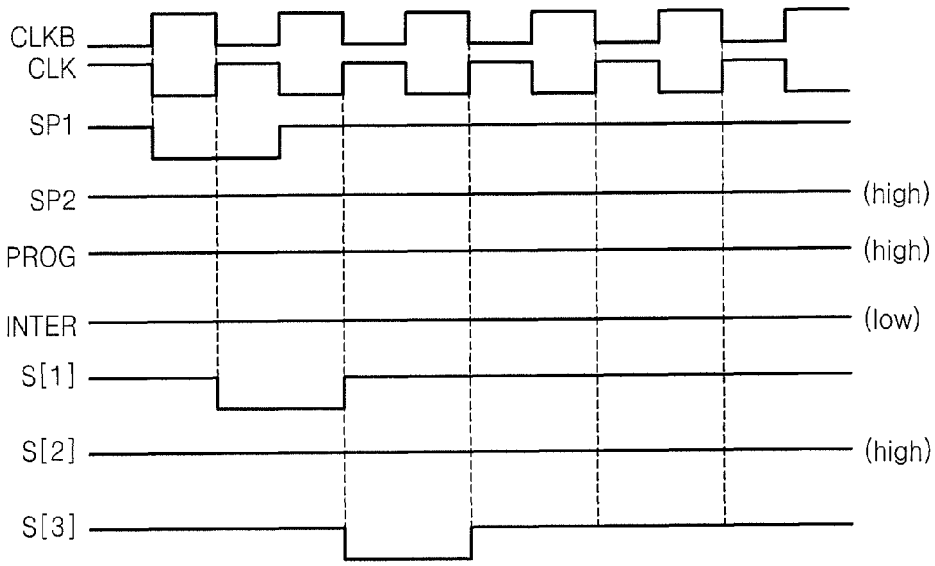
FIG. 4 is a timing diagram for describing a scanning operation of an odd scanning line during an interlaced scanning operation of the scan driver of FIG. 1.

FIG. 4 is a timing diagram for describing a scanning operation of an odd scanning line during an interlaced scanning operation of the scan driver of FIG. 1.

In the interlaced scanning operation, according to one embodiment, the first mode signal PROG has a high level value and the second mode signal INTER has a low level value. Accordingly, the first transistors Tr1-1 through Tr(n-1)-1 respectively included in the input signal select circuits 1 through n-1 are turned off, and the second transistors Tr1-2 through Tr(n-1)-2 respectively included in the input signal select circuits 1 through n-1 are turned on. The clock signal CLK and the inverse clock signal CLKB are continuously applied to each of the scan stages STG1 through STGn.

When an operation for displaying an image begins, for example, when the flat panel display apparatus is turned on, the first scan start signal SP1 is applied to the input terminal of the first scan stage STG1.

Referring back to FIG. 2, the first latch 110 samples the first scan start signal SP1 at the falling edge of the clock signal CLK, and the second latch 120 samples the output signal of the first latch 110 at the rising edge of the clock signal CLK. Here, the output signal of the second latch 120 is the output signal of the first scan stage STG1, and it is also the scan signal. The first scan start signal SP1 is output as the output signal after being shifted by a half cycle of the clock signal CLK.

The output signal of the first scan stage STG1 is output at the rising edge of the clock signal CLK, and is output for a cycle of the clock signal CLK. Since the first transistor Tr1-1 of the first input signal select circuit 1 is turned off, a connection between the first input signal select circuit 1 and the second scan stage STG2 is disconnected or blocked. On the other hand, since the second transistor Tr2-2 of the second input signal select circuit 2 is turned on, the output signal of the first scan stage STG1 is applied to the input terminal of the third scan stage STG3. In other words, the input signal is applied to the third scan stage STG3, which is the next odd scan stage, after skipping the second scan stage STG2, which is an even scan stage.

The output signal of the first scan stage STG1 is applied to the third scan stage STG3 at the rising edge of the clock signal CLK, but the output signal is sampled at the next falling edge of the clock signal CLK, and the output signal of the third scan stage STG3 is output at the next rising edge of the clock signal CLK. Accordingly, scan signals may be sequentially generated without overlapping between an output signal of a previous scan stage and an output signal of a current scan stage.

By repeating the above processes, the scan driver operates according to the interlaced scanning method, wherein the odd scan stages STG1 through STGn-1 sequentially apply a scan signal to the odd scanning lines in response to the application of the first scan start signal SP1.

Figure 5:
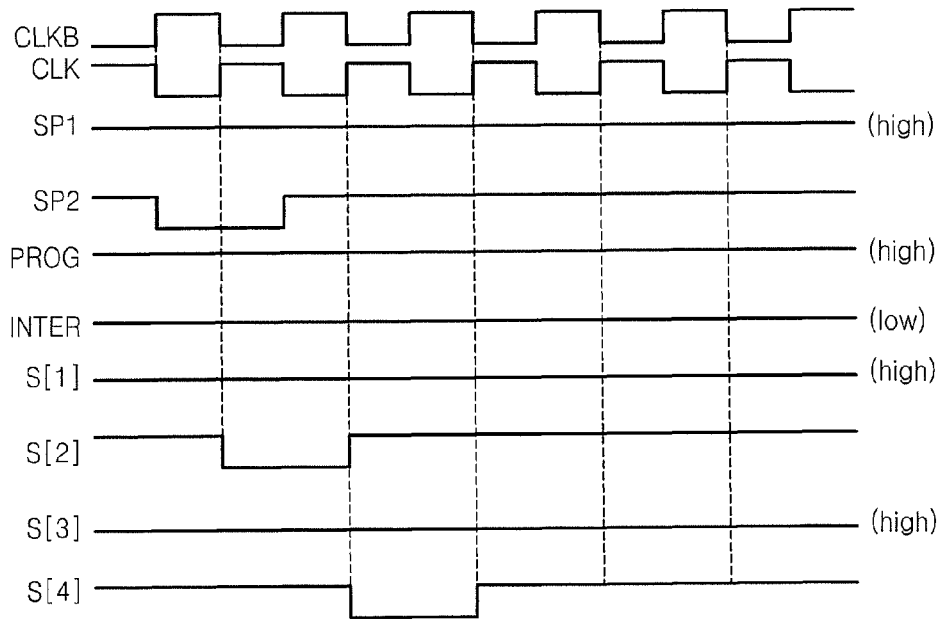
FIG. 5 is a timing diagram for describing a scanning operation of an even scanning line during the interlaced scanning operation of the scan driver of FIG. 1.

FIG. 5 is a timing diagram for describing a scanning operation of an even scanning line during the interlaced scanning operation of the scan driver of FIG. 1.

As described in reference to FIG. 4, in the interlaced scanning operation, the first mode signal PROG has a high level value and the second mode signal INTER has a low level value. The first transistors Tr1-1 through Tr(n-1)-1 respectively included in the input signal select circuits 1 through n-1 are turned off, and the second transistors Tr1-2 through Tr(n-1)-2 respectively included in the input signal select circuits 1 through n-1 are turned on. The clock signal CLK and the inverse clock signal CLKB are continuously applied to each of the scan stages STG1 through STGn.

When an operation for displaying an image begins, for example, when the flat panel display apparatus is turned on, the second scan start signal SP2 is applied to the second transistor Tr1-2 of the first input signal select circuit 1. Alternatively, when a scanning operation of the odd scanning line is completed, the second scan start signal SP2 is applied to the second transistor Tr1-2 of the first input signal select circuit 1.

Since the second transistor Tr1-2 is turned on, the second scan start signal SP2 is applied to the input terminal of the second scan stage STG2. The first latch 110 samples the second scan start signal SP2 at the falling edge of the clock signal CLK, and the second latch 120 samples the output signal of the first latch 110 at the rising edge of the clock signal CLK. The output signal of the second latch 120 is the output signal of the second scan stage STG2, and it is also the scan signal of the second scanning line. The second scan start signal SP2 is output as the output signal after being shifted by a half cycle of the clock signal CLK.

The output signal of the second scan stage STG2 is output at the rising edge of the clock signal CLK, and it is output in accordance with a cycle of the clock signal CLK. Since the first transistor Tr2-1 of the second input signal select circuit 2 is turned off, the connection between the second scan stage STG2 and the third scan stage STG3 is blocked or disconnected. On the other hand, since the second transistor Tr3-2 of the third input signal select circuit 3 is turned on, the output signal of the second scan stage STG2 is applied to the input terminal of the fourth scan stage STG4. In other words, the third scan stage STG3 (i.e., an odd scan stage) is skipped, and the output signal of the second scan stage STG2 is applied to the fourth scan stage STG4 (i.e., a following even scan stage).

The output signal of the second scan stage STG2 is applied to the fourth scan stage STG4 at the rising edge of the clock signal CLK, but it is sampled at the next falling edge of the clock signal CLK, and the output signal of the fourth scan stage STG4 is output at the next rising edge of the clock signal CLK. Accordingly, scan signals are sequentially generated without overlapping between an output signal of a previous scan stage and an output signal of a current scan stage.

By repeating the above processes, the scan driver operates according to the interlaced scanning method, wherein all even scan stages STG2 through STGn sequentially apply a scan signal to even scanning lines in response to the application of the second scan start signal SP2.

The second scan start signal SP2 may be generated separately from the first scan start signal SP1. However, embodiments of the present invention are not limited thereto. For example, the second scan start signal SP2 may be a scan signal that is last generated during the interlaced scanning operation of the odd scanning lines (e.g., the output signal of the n-1$^{th}$ scan stage STGn-1). In other words, when the interlaced scanning operation of the odd scanning lines is completed, the interlaced scanning operation of the even scanning lines may be continuously performed by using the output signal of the n-1$^{th}$ scan stage STGn-1.

As described above, a scanning operation of one frame may be performed by combining the interlaced scanning operations of FIGS. 4 and 5 as one set.

Figure 6:
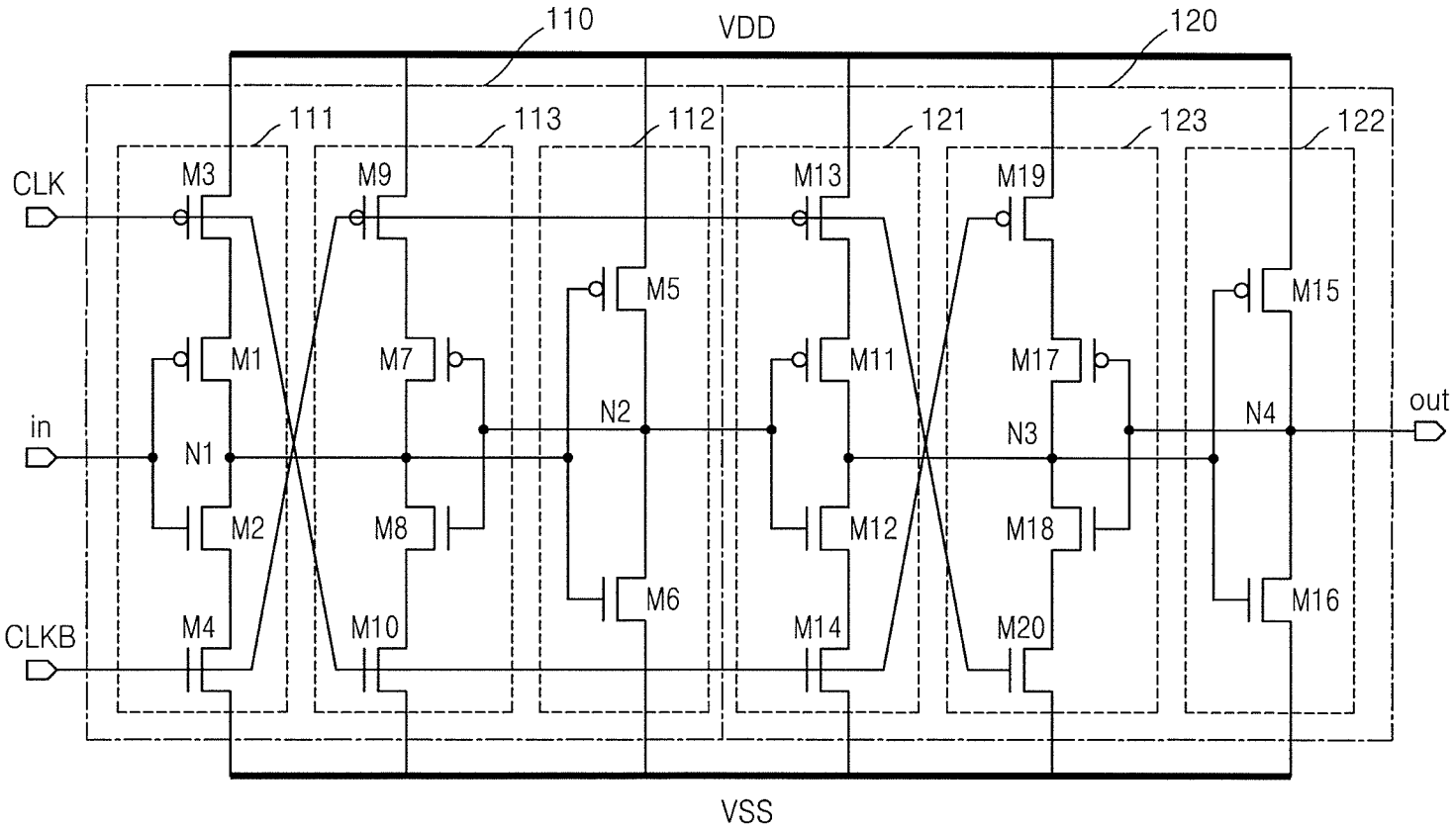
FIG. 6 is a circuit diagram illustrating in more detail the scan stage of FIG. 2.

FIG. 6 is a circuit diagram illustrating in more detail the scan stage of FIG. 2.

According to one embodiment, the flip-flop of FIG. 2 includes a plurality of inverters, and each inverter may include two or four transistors.

The first inverter 111 includes a first transistor M1, a second transistor M2, a third transistor M3 and a fourth transistor M4 (e.g., two NMOS transistors and two PMOS transistors). The first and second transistors M1 and M2 perform an inverting operation to an input signal, and the third and fourth transistors M3 and M4 control the inverting operation to be performed only when the clock signal CLK is at a low level and the inverse clock signal CLKB is at a high level.

The second inverter 112 includes fifth and sixth transistors M5 and M6 (e.g., one NMOS transistor and one PMOS transistor). The second inverter 112 inverts a value of a first node N1, which is an output of the first inverter 111, and outputs the inverted value to a second node N2.

The third inverter 113 includes a seventh transistor M7, an eighth transistor M8, a ninth transistor M9 and a tenth transistor M10 (e.g., two NMOS transistors and two PMOS transistors). The seventh and eighth transistors M7 and M8 perform an inverting operation to a value applied to the second node N2, and the ninth and tenth transistors M9 and M10 control the inverting operation to be performed only when the clock signal CLK is at a high level and the inverse clock signal CLKB is at a low level.

The fourth inverter 121 includes an eleventh transistor M11, a twelfth transistor M12, a thirteenth transistor M13 and a fourteenth transistor M14 (e.g., two NMOS transistors and two PMOS transistors). The eleventh and twelfth transistors M11 and M12 perform an inverting operation to the value applied to the second node N2, and the thirteenth and fourteenth transistors M13 and M14 control the inverting operation to be performed only when the clock signal CLK is at a high level and the inverse clock signal CLKB is at a low level.

The fifth inverter 122 includes fifteenth and sixteenth transistors M15 and M16 (e.g., one NMOS transistor and one PMOS transistor). The fifth inverter 122 inverts a value of a third node N3, which is an output of the fourth inverter 121, and outputs the inverted value to a fourth node N4 connected to the output terminal of the scan stage of FIG. 6.

The sixth inverter 123 includes a seventeenth transistor M17, an eighteenth transistor M18, a nineteenth transistor M19 and a twentieth transistor M20 (e.g., two NMOS transistors and two PMOS transistors). The seventeenth and eighteenth transistors M17 and M18 perform an inverting operation to the value applied to the fourth node N4, and the nineteenth and twentieth transistors M19 and M20 control the inverting operation to be performed only when the clock signal CLK is at a low level and the inverse clock signal CLKB is at a high level.

Detailed operations of the first through third inverters 111 through 113 and fourth through sixth inverters 121 through 123 are identical to the operations of the scan stage of FIG. 2, and thus descriptions thereof will not be repeated.

Figure 7:
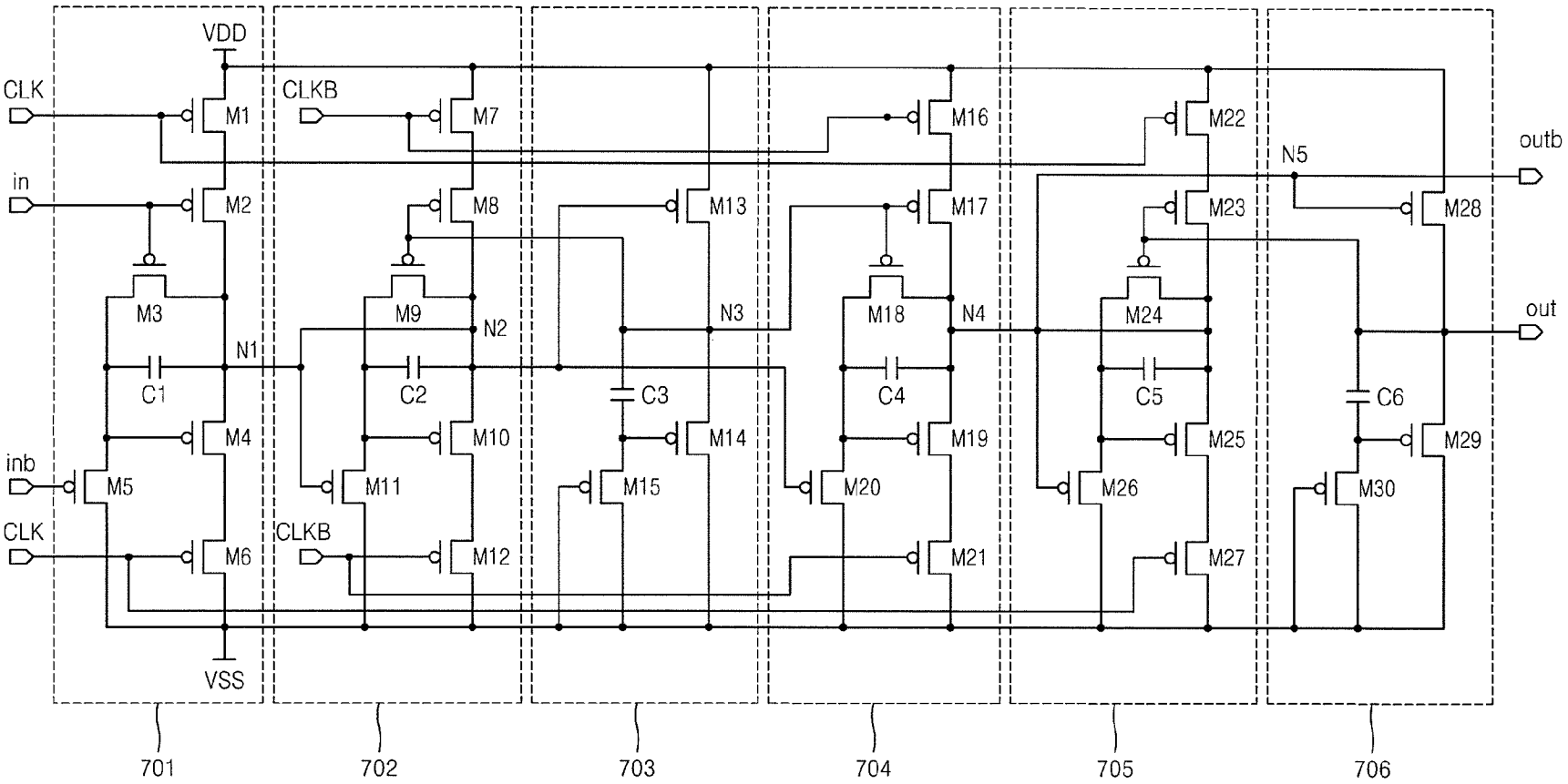
FIG. 7 is a circuit diagram of a scan stage included in the scan driver of FIG. 1, according to another embodiment of the present invention.

FIG. 7 is a circuit diagram of a scan stage included in the scan driver of FIG. 1, according to another embodiment of the present invention.

Referring to FIG. 7, the scan stage may include a first signal processor 701 for generating a first output signal at a first output node N1 in response to receiving a clock signal CLK, an input signal (in), and an inverse input signal (inb); a second signal processor 702 for generating a second output signal at a second node N2 in response to receiving the first output signal at the first output node N1, an inverse clock signal CLKB, and a first negative feedback signal; a third signal processor 703 for generating a third output signal N3 in response to receiving the second output signal at the second node N2; a fourth signal processor 704 for generating a fourth output signal N4 in response to receiving the second output signal at the second node N2, the third output signal at the third node N3, and the inverse clock signal CLKB; a fifth signal processor 705 for generating a fifth output signal at a fifth node N5 in response to receiving the fourth output signal at the fourth node N4, the clock signal CLK, and a second negative feedback signal; and a sixth signal processor 706 for generating an output signal (out) in response to receiving the fifth output signal at the fifth node N5. Here, the first negative feedback signal is the third output signal at the third node N3, the second negative feedback signal is the output signal (out), and the fifth output signal at the fifth node N5 may be an inverse output signal (outb) of the scan stage. The scan stage of FIG. 7 may be, for example, the first scan stage STG1, and in this case, the input signal (in) may be the first scan start signal SP1.

The first signal processor 701 includes a first transistor M1, a second transistor M2, a third transistor M3, a fourth transistor M4, a fifth transistor M5, a sixth transistor M6, and a first capacitor C1.

The first transistor M1 has a first terminal to which a first power voltage VDD is applied, a second terminal connected to the second transistor M2, and a control terminal (gate terminal) to which the clock signal CLK is applied. Here, the first and second terminals may be respectively source and drain terminals or vice versa. When the clock signal CLK of a low level is input to the control terminal of the first transistor M1, the first transistor M1 is turned on, and thus the first power voltage VDD is supplied to a first terminal of the second transistor M2.

The second transistor M2 has the first terminal electrically connected to the second terminal of the first transistor M1, a second terminal electrically connected to a second terminal of the third transistor M3, and a control terminal to which the input signal (in) is applied. When the input signal (in) of a low level is input to the control terminal of the second transistor M2, the second transistor M2 is turned on, and supplies the first power voltage VDD received from the first transistor M1 as the first output signal at the first output node N1.

The third transistor M3 has a first terminal electrically connected to a first terminal of the first capacitor C1, the second terminal electrically connected to a second terminal of the first capacitor C1, and a control terminal to which the input signal (in) is applied. When the input signal (in) of a low level is input to the control terminal of the third transistor M3, the third transistor M3 is turned on, and thus blocks (or prevents) a second power voltage VSS from being supplied as the first output signal at the first output node N1 by connecting the fourth transistor M4 in a diode structure (e.g., diode-connected).

The fourth transistor M4 has a control terminal electrically connected to the first terminal of the first capacitor C1 and a first terminal of the fifth transistor M5, a first terminal electrically connected to the second terminal of the first capacitor C1, and a second terminal electrically connected to a first terminal of the sixth transistor M6. The fourth transistor M4 is a driving transistor, and when the third transistor M3 is turned on, the fourth transistor M4 has a diode structure (or is diode-connected) for transferring a current from a source for supplying the first power voltage VDD to another source for supplying the second power voltage VSS, and when the fifth and sixth transistors M5 and M6 are turned on, the fourth transistor M4 has a diode structure for transferring a current from the source for supplying the second power voltage VSS to the source for supplying the first power voltage VDD.

The fifth transistor M5 has the first terminal electrically connected to the first terminal of the first capacitor C1 and the control terminal of the fourth transistor M4, a second terminal to which the second power voltage VSS is applied, and a control terminal to which the inverse input signal (inb) is applied. When the inverse input signal (inb) of a low level is input to the control terminal of the fifth transistor M5, the fifth transistor M5 is turned on and thus connects the fourth transistor M4 in a diode structure.

The sixth transistor M6 has the first terminal electrically connected to the second terminal of the fourth transistor M4, a second terminal to which the second power voltage VSS is applied, and a control terminal to which the clock signal CLK is applied. When the clock signal CLK of a low level is input to the control terminal of the sixth transistor M6, the sixth transistor M6 is turned on and thus supplies the second power voltage VSS to the fourth transistor M4.

The first capacitor C1 has the first terminal electrically connected to the first terminal of the third transistor M3, and the second terminal electrically connected to the second terminal of the third transistor M3.

The second signal processor 702 includes seventh, eighth, ninth, tenth, eleventh and twelfth transistors M7, M8, M9, M10, M11 and M12 and a second capacitor C2.

The seventh transistor M7 has a first terminal to which the first power voltage VDD is applied, a second terminal electrically connected to the eighth transistor M8, and a control terminal to which the inverse clock signal CLKB is applied. The seventh transistor M7 is turned on when the inverse clock signal CLKB (e.g., a low level signal) is input to the control terminal thereof, and thus supplies the first power voltage VDD to a first terminal of the eighth transistor M8.

The eighth transistor M8 has the first terminal electrically connected to the second terminal of the seventh transistor M7, a second terminal electrically connected to a second terminal of the ninth transistor M9, and a control terminal to which the first negative feedback signal at the third node N3 is applied. The eighth transistor M8 is turned on when the first negative feedback signal (e.g., a low level signal) at the third node N3 is input to the control terminal thereof, and thus supplies the first power voltage VDD received from the seventh transistor M7 as the second output signal at the second node N2.

The ninth transistor M9 has a first terminal electrically connected to a first terminal of the second capacitor C2, the second terminal electrically connected to a second terminal of the second capacitor C2, and a control terminal to which the first negative feedback signal at the third node N3 is applied. The ninth transistor M9 is turned on when the first negative feedback signal at the third node N3 is input to the control terminal thereof, and thus blocks (or prevents) the second power voltage VSS from being supplied as the second output signal at the second node N2 by connecting the tenth transistor M10 in a diode structure (e.g., diode-connected).

The tenth transistor M10 has a control terminal electrically connected to the first terminal of the second capacitor C2 and a first terminal of the eleventh transistor M11, a first terminal electrically connected to the second terminal of the second capacitor C2, and a second terminal electrically connected to a first terminal of the twelfth transistor M12. The tenth transistor M10 is a driving transistor. When the ninth transistor M9 is turned on, the tenth transistor M10 has a diode structure for transferring a current from the source for supplying the first power voltage VDD to the source for supplying the second power voltage VSS, and when the eleventh and twelfth transistors M11 and M12 are turned on, the tenth transistor M10 has a diode structure for transferring a current from the source for supplying the second power voltage VSS to the source for supplying the first power voltage VDD.

The eleventh transistor M11 has the first terminal electrically connected to the first terminal of the second capacitor C2 and the control terminal of the tenth transistor M10, a second terminal to which the second power voltage VSS is applied, and a control terminal to which the first output signal at the first output node N1 is supplied. The eleventh transistor M11 is turned on when the first output signal at the first output node N1 of a low level is input to the control terminal thereof, and thus connects the tenth transistor M10 in a diode structure.

The twelfth transistor M12 has the first terminal electrically connected to the second terminal of the tenth transistor M10, a second terminal to which the second power voltage VSS is applied, and a control terminal to which the inverse clock signal CLKB is applied. The twelfth transistor M12 is turned on when the inverse clock signal CLKB of a low level is input to the control terminal thereof, and thus supplies the second power voltage VSS to the tenth transistor M10.

The second capacitor C2 has the first terminal electrically connected to the first terminal of the ninth transistor M9, and the second terminal electrically connected to the second terminal of the ninth transistor M9.

The third signal processor 703 includes thirteenth, fourteenth and fifteenth transistors M13, M14 and M15 and a third capacitor C3.

The thirteenth transistor M13 has a first terminal to which the first power voltage VDD is applied, and a control terminal to which the second output signal at the second node N2 is applied. The thirteenth transistor M13 is turned on when the second output signal at the second node N2 of a low level is input to the control terminal thereof, and thus supplies the first power voltage VDD as the third output signal at the third node N3.

The fourteenth transistor M14 has a first terminal electrically connected to the thirteenth transistor M13, a second terminal to which the second power voltage VSS is applied, and a control terminal electrically connected to a first terminal of the fifteenth transistor M15. The fourteenth transistor M14 is turned on when a signal of a low level is input to a control terminal of the fourteenth transistor M14 when the fifteenth transistor M15 is turned on, and thus supplies the second power voltage VSS as the third output signal at the third node N3.

The fifteenth transistor M15 has the first terminal electrically connected to the control terminal of the fourteenth transistor M14, a second terminal to which the second power voltage VSS is applied, and a control terminal to which the second power voltage VSS is applied. The fifteenth transistor M15 is turned on when the second power voltage VSS is applied to the control terminal thereof, and thus supplies the second power voltage VSS to the control terminal of the fourteenth transistor M14.

The third capacitor C3 has a first terminal connected to the control terminals of the eighth and ninth transistors M8 and M9, and a second terminal electrically connected to the control terminal of the fourteenth transistor M14.

The fourth signal processor 704 includes sixteenth, seventeenth, eighteenth, nineteenth, twentieth and twenty-first transistors M16, M17, M18, M19, M20 and M21 and a fourth capacitor C4.

The sixteenth transistor M16 has a first terminal to which the first power voltage VDD is applied, a second terminal electrically connected to the seventeenth transistor M17, and a control terminal to which the inverse clock signal CLKB is applied. The sixteenth transistor M16 is turned on when the inverse clock signal CLKB of a low level is input to the control terminal thereof, and thus supplies the first power voltage VDD to a first terminal of the seventeenth transistor M17.

The seventeenth transistor M17 has the first terminal electrically connected to the second terminal of the sixteenth transistor M16, a second terminal electrically connected to a second terminal of the eighteenth transistor M18, and a control terminal to which the third output signal at the third node N3 is applied. The seventeenth transistor M17 is turned on when a signal of a low level is input to the control terminal thereof, and thus supplies the first power voltage VDD received from the sixteenth transistor M16 as the fourth output signal at the fourth node N4.

The eighteenth transistor M18 has a first terminal electrically connected to a first terminal of the fourth capacitor C4, the second terminal electrically connected to a second terminal of the fourth capacitor C4, and a control terminal to which the third output signal at the third node N3 is applied. The eighteenth transistor M18 is turned on when the third output signal at the third node N3 of a low level is input to the control terminal thereof, and thus blocks (or prevents) the second power voltage VSS from being supplied as the fourth output signal at the fourth node N4 by connecting the nineteenth transistor M19 in a diode structure.

The nineteenth transistor M19 has a control terminal electrically connected to the first terminal of the fourth capacitor C4 and a first terminal of the twentieth transistor M20, a first terminal electrically connected to the second terminal of the fourth capacitor C4, and a second terminal electrically connected to a first terminal of the twenty-first transistor M21. The nineteenth transistor M19 is a driving transistor, and when the eighteenth transistor M18 is turned on, the nineteenth transistor M19 has a diode structure for transferring a current from the source for supplying the first power voltage VDD to the source for supplying the second power voltage VSS, and when the twentieth and twenty-first transistors M20 and M21 are turned on, the nineteenth transistor M19 has a diode structure for transferring a current from the source for supplying the second power voltage VSS to the source for supplying the first power voltage VDD.

The twentieth transistor M20 has the first terminal electrically connected to the first terminal of the fourth capacitor C4 and the control terminal of the nineteenth transistor M19, a second terminal to which the second power voltage VSS is applied, and a control terminal to which the second output signal at the second node N2 is applied. The twentieth transistor M20 is turned on when the second output signal at the second node N2 of a low level is input to the control terminal thereof, and thus connects the nineteenth transistor M19 in a diode structure.

The twenty-first transistor M21 has the first terminal electrically connected to the second terminal of the nineteenth transistor M19, a second terminal to which the second power voltage VSS is applied, and a control terminal to which the inverse clock signal CLKB is applied. The twenty-first transistor M21 is turned on when the inverse clock signal CLKB of a low level is input to the control terminal thereof, and thus supplies the second power voltage VSS to the nineteenth transistor M19.

The fourth capacitor C4 has the first terminal electrically connected to the first terminal of the eighteenth transistor M18, and the second terminal electrically connected to the second terminal of the eighteenth transistor M18.

The fifth signal processor 705 includes twenty-second, twenty-third, twenty-fourth, twenty-fifth, twenty-sixth and twenty-seventh transistors M22, M23, M24, M25, M26 and M27 and a fifth capacitor C5.

The twenty-second transistor M22 has a first terminal to which the first power voltage VDD is applied, a second terminal electrically connected to the twenty-third transistor M23, and a control terminal to which the clock signal CLK is applied. The twenty-second transistor M22 is turned on when the clock signal CLK of a low level is input to the control terminal thereof, and thus supplies the first power voltage VDD to a first terminal of the twenty-third transistor M23.

The twenty-third transistor M23 has the first terminal electrically connected to the second terminal of the twenty-second transistor M22, a second terminal electrically connected to the twenty-fourth transistor M24, and a control terminal electrically connected to an output terminal via which the second negative feedback signal is output as the output signal (out). The twenty-third transistor M23 is turned on when the second negative feedback signal (out) of a low level is input to the control terminal thereof, and thus transfers the first power voltage VDD received from the twenty-second transistor M22 to the twenty-fifth transistor M25.

The twenty-fourth transistor M24 has a first terminal electrically connected to a first terminal of the fifth capacitor C5, a second terminal electrically connected to a second terminal of the fifth capacitor C5, and a control terminal to which the second negative feedback signal (out) is applied. The twenty-fourth transistor M24 is turned on when the second negative feedback signal (out) of a low level is input to the control terminal thereof, and thus connects the twenty-fifth transistor M25 in a diode structure.

The twenty-fifth transistor M25 has a control terminal electrically connected to the first terminal of the fifth capacitor C5 and a first terminal of the twenty-sixth transistor M26, a first terminal electrically connected to the second terminal of the fifth capacitor C5, and a second terminal electrically connected to a first terminal of the twenty-seventh transistor M27. The twenty-fifth transistor M25 is a driving transistor. When the twenty-fourth transistor M24 is turned on, the twenty-fifth transistor M25 has a diode structure for transferring a current from the source for supplying the first power voltage VDD to the source for supplying the second power voltage VSS, and when the twenty-sixth and twenty-seventh transistors M26 and M27 are turned on, the twenty-fifth transistor M25 has a diode structure for transferring a current from the source for supplying the second power voltage VSS to the source for supplying the first power voltage VDD.

The twenty-sixth transistor M26 has the first terminal electrically connected to the first terminal of the fifth capacitor C5 and the control terminal of the twenty-fifth transistor M25, a second terminal to which the second power voltage VSS is applied, and a control terminal to which the fourth output signal at the fourth node N4 is applied. The twenty-sixth transistor M26 is turned on when the fourth output signal at the fourth node N4 of a low level is input to the control terminal thereof, and thus connects the twenty-fifth transistor M25 in a diode structure.

The twenty-seventh transistor M27 has the first terminal electrically connected to the second terminal of the twenty-fifth transistor M25, a second terminal to which the second power voltage VSS is applied, and a control terminal to which the clock signal CLK is applied. The twenty-seventh transistor M27 is turned on when the clock signal CLK of a low level is input to the control terminal thereof, and thus supplies the second power voltage VSS to the twenty-fifth transistor M25.

The fifth capacitor C5 has the first terminal electrically connected to the first terminal of the twenty-fourth transistor M24, and the second terminal electrically connected to the second-terminal of the twenty-fourth transistor M24.

The sixth signal processor 706 includes twenty-eighth, twenty-ninth and thirtieth transistors M28, M29 and M30 and a sixth capacitor C6.

The twenty-eighth transistor M28 has a first terminal to which the first power voltage VDD is applied, a second terminal electrically connected to a first terminal of the twenty-ninth transistor M29, and a control terminal to which the fifth output signal at the fifth node N5 is applied. The twenty-eighth transistor M28 is turned on when the fifth output signal at the fifth node N5 of a low level is input to the control terminal thereof, and thus supplies the first power voltage VDD as the output signal (out) at the output terminal.

The twenty-ninth transistor M29 has the first terminal electrically connected to the second terminal of the twenty-eighth transistor M28, a second terminal to which the second power voltage VSS is applied, and a control terminal electrically connected to a first terminal of the thirtieth-transistor M30. The twenty-ninth transistor M29 is turned on when a signal of a low level is input to the control terminal of the twenty-ninth transistor M29 when the thirtieth transistor M30 is turned on, and thus supplies the second power voltage VSS as the output signal (out) at the output terminal.

The thirtieth transistor M30 has the first terminal electrically connected to the control terminal of the twenty-ninth transistor M29, a second terminal to which the second power voltage VSS is applied, and a control terminal to which the second power voltage VSS is applied. The thirtieth transistor M30 is turned on by the second power voltage VSS applied to the control terminal thereof, and thus supplies the second power voltage VSS to the control terminal of the twenty-ninth transistor M29.

The sixth capacitor C6 has a first terminal electrically connected to the control terminals of the twenty-third and twenty-fourth transistors M23 and M24, and a second terminal electrically connected to the control terminal of the twenty-ninth transistor M29.

In FIG. 7, the first through thirtieth transistors M1 through M30 are PMOS transistors.

Figure 8:
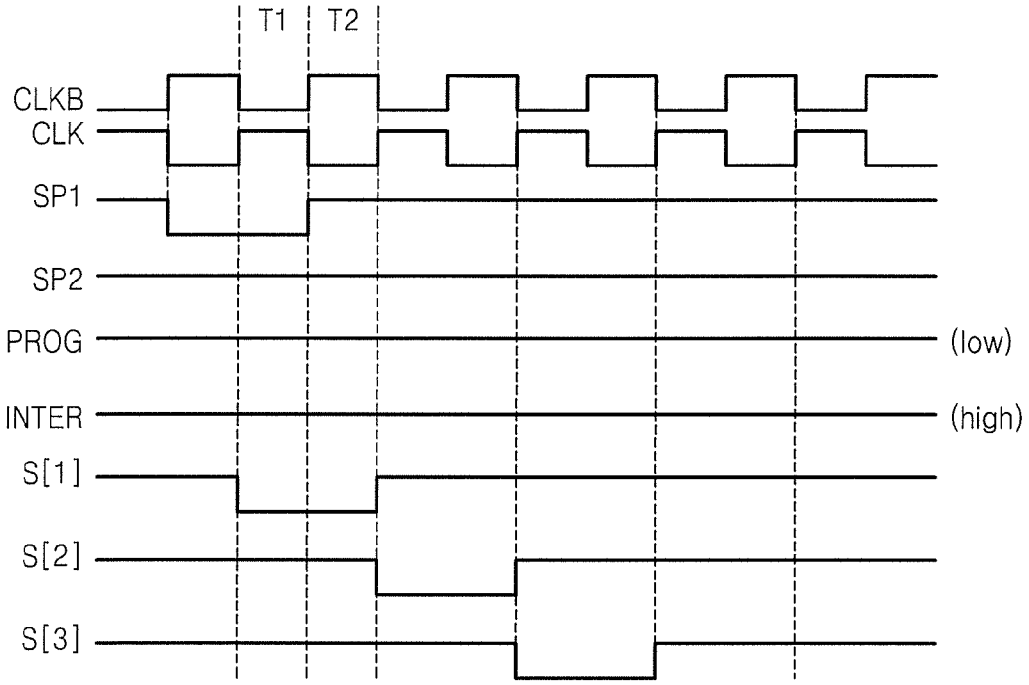
FIG. 8 is a timing diagram for describing an operation of the scan stage of FIG. 7.

FIG. 8 is a timing diagram for describing an operation of the scan stage of FIG. 7.

During a first driving interval T1, the inverse clock signal CLKB is at a low level, the clock signal CLK is at a high level, the input signal (in) is at a low level, and the inverse input signal (inb) is at a high level. In FIGS. 7 and 8, the input signal (in) may be a first scan start signal SP1 and the inverse input signal (inb) may be an inverted signal of the first scan start signal SP1.

In the first signal processor 701, during the first driving interval T1, the first and sixth transistors M1 and M6 are turned off by the clock signal CLK of a high level, and thus the first and second power voltages VDD and VSS are not output as the first output signal at the first output node N1. Here, since the first and second nodes N1 and N2 are connected to each other, a value of the second output signal at the second node N2 is identical to the first output signal at the first output node N1. In the second and third signal processors 702 and 703, the second power voltage VSS is output as the first negative feedback signal at the third node N3 since the fourteenth transistor M14 is floated by the fifteenth transistor M15, and thus the eighth and ninth transistors M8 and M9 are turned on. Also, the seventh transistor M7 is turned on by the inverse clock signal CLKB of a low level, and thus the first power voltage VDD is output as the second output signal at the second node N2. Accordingly, the first power voltage VDD is also output as the first output signal at the first output node N1. In the fourth and fifth signal processors 704 and 705, the sixteenth and twenty-first transistors M16 and M21 are turned on by the inverse clock signal CLKB of a low level. Also, the seventeenth and eighteenth transistors M17 and M18 are turned on by the third output signal at the third node N3. Accordingly, the first power voltage VDD is output as the fourth output signal at the fourth node N4. Since the fourth and fifth nodes N4 and N5 are connected to each other, a value of the fourth output signal at the fourth node N4 is identical to the fifth output signal at the fifth node N5. In the sixth signal processor 706, when the twenty-eighth transistor M28 is turned off by the fifth output signal at the fifth node N5, the first power voltage VDD is not applied as an output signal (out) at the output terminal, and the second power voltage VSS is output as the output signal (out) at the output terminal as the thirtieth transistor M30 is turned on and the twenty-ninth transistor M29 is floated. In FIGS. 7 and 8, the output signal (out) may be a first scan signal S[1].

Then, during a second driving interval T2, the inverse clock signal CLKB is at a high level, the clock signal CLK is at a low level, the input signal (in) is at a high level, and the inverse input signal (inb) is at a low level. In FIGS. 7 and 8, the input signal (in) may be a first scan start signal SP1. The inverse input signal (inb) may be an inverted signal of the first scan start signal SP1.

In the first signal processor 701, during the second driving interval T2, the fifth and sixth transistors M5 and M6 are turned on by the clock signal CLK of a low level and the inverse input signal (inb) of a low level. Accordingly, the fourth transistor M4 is turned on, and thus outputs the second power voltage VSS as the first output signal at the first output node N1. The fifth transistor M5 is turned on so as to block (or prevent) the first power voltage VDD from being supplied as the first output signal at the first output node N1 by connecting the fourth transistor M4 in a diode structure. In the second signal processor 702, the seventh and twelfth transistors M7 and M12 are turned off by the inverse clock signal CLKB of a high level, and the first output signal at the first output node N1 is output as the second output signal at the second node N2. In the third signal processor 703, the thirteenth transistor M13 is turned on by the second output signal at the second node N2, and thus the first power voltage VDD is output as the third output signal at the third node N3. In the fourth signal processor 704, the twentieth transistor M20 is turned on by the second output signal at the second node N2, but the twenty-first and sixteenth transistors M21 and M16 are turned off by the inverse clock signal CLKB. Accordingly, the first and second power voltages VDD and VSS are not output as the fourth output signal at the fourth node N4. In the sixth signal processor 706, the second power voltage VSS is output as the output signal (out) at the output terminal as the twenty-ninth transistor M29 is floated by the sixth capacitor C6. Accordingly, in the fourth and fifth signal processors 704 and 705, the twenty-third and twenty-fourth transistors M23 and M24 are turned on since the second power voltage VSS is output as the output signal (out) at the output terminal, the first power voltage VDD is output as the fourth output signal at the fourth node N4 since the twenty-second transistor M22 is turned on by the clock signal CLK of a low level, and thus the first power voltage VDD is also output as the fifth output signal at the fifth node N5. In FIGS. 7 and 8, the output signal (out) may be a first scan signal S[1].

Figure 9:
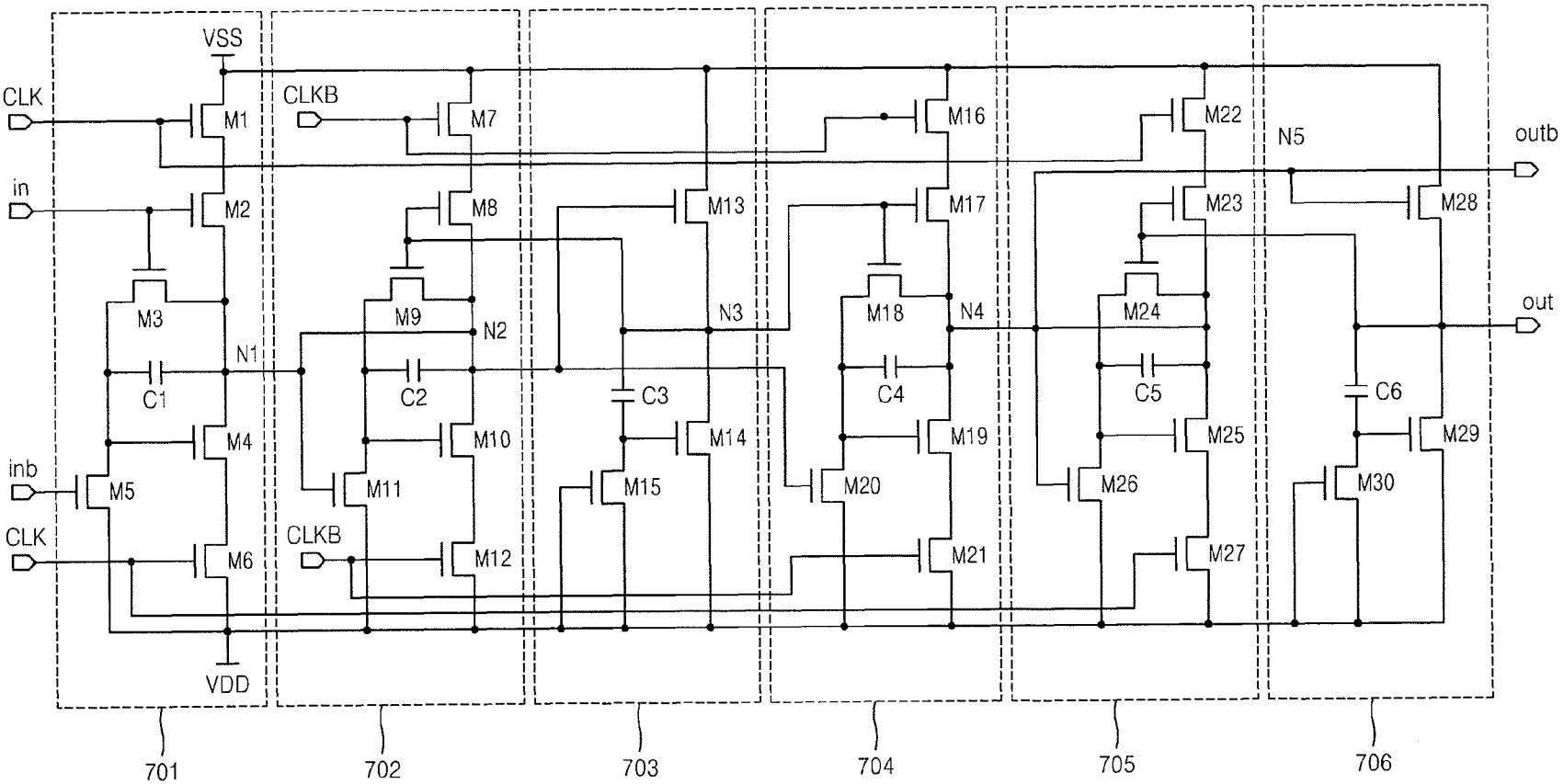
FIG. 9 is a circuit diagram of a scan stage included in the scan driver of FIG. 1, according to another embodiment of the present invention.

FIG. 9 is a circuit diagram of a scan stage included in the scan driver of FIG. 1, according to another embodiment of the present invention. In FIG. 9, the first through thirtieth transistors M1 through M30 are NMOS transistors, compared to the scan stage of FIG. 7. Other than that, the connections and driving methods of the first through thirtieth transistors M1 through M30 are identical to those of the scan stage of FIG. 7, and thus detailed descriptions thereof are not repeated.

Figure 10:
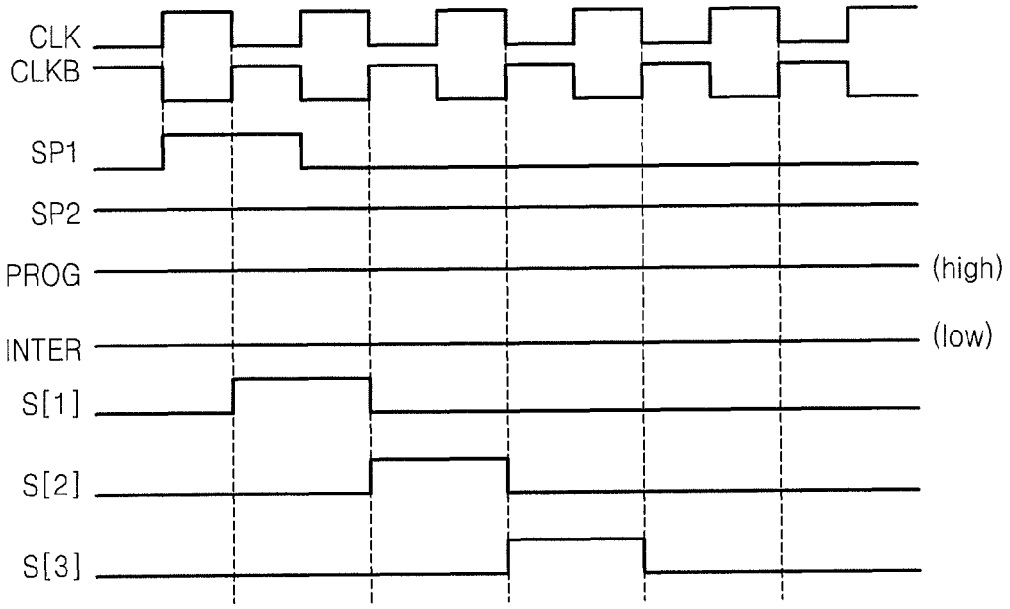
FIG. 10 is a timing diagram for describing an operation of the scan stage of FIG. 9.

FIG. 10 is a timing diagram for describing an operation of the scan stage of FIG. 9. The timing diagram of FIG. 10 is similar to the timing diagram of FIG. 8, except that the locations of the first and second power voltages VDD and VSS are switched in the scan stage, a terminal of the clock signal CLK and a terminal of the inverse clock signal CLKB are switched in the scan stage, and a low level and a high level are reversed. Accordingly, detailed descriptions about the timing diagram of FIG. 10 will not be repeated.

Figure 11:
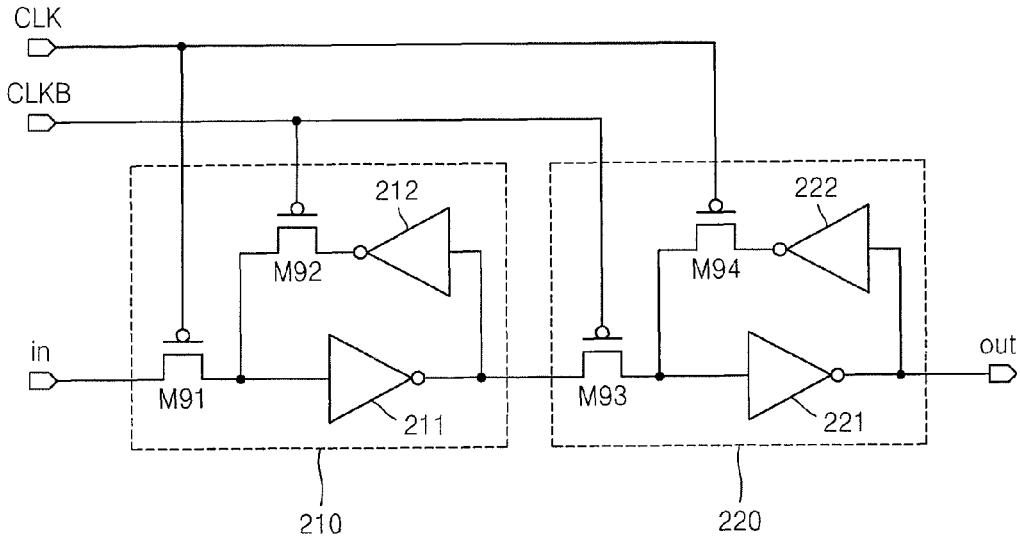
FIG. 11 is a circuit diagram of a scan stage included in the scan driver of FIG. 1, according to another embodiment of the present invention.

FIG. 11 is a circuit diagram of a scan stage included in the scan driver of FIG. 1, according to another embodiment of the present invention.

Referring to FIG. 11, the scan stage according to an embodiment of the present invention includes a third latch 210 and a fourth latch 220 that are connected in series. The third latch 210 includes switching transistors M91 and M92 and seventh and eighth inverters 211 and 212, and the fourth latch 220 includes switching transistors M93 and M94 and ninth and tenth inverters 221 and 222.

The switching transistor M91 has a first terminal to which an input signal (in) is applied and a second terminal connected to an input terminal of the seventh inverter 211. A clock signal CLK is applied to a gate terminal of the switching transistor M91, and the input signal (in) is applied to the seventh inverter 211 when the clock signal CLK is at a low level.

The seventh and eighth inverters 211 and 212 each output an inverted signal of an applied input signal.

The switching transistor M92 has a first terminal connected to an output terminal of the eighth inverter 212, and a second terminal connected to the input terminal of the seventh inverter 211. An inverse clock signal CLKB is applied to a gate terminal of the switching transistor M92, and an output signal of the eighth inverter 212 is applied to the input terminal of the seventh inverter 211 when the inverse clock signal CLKB is at a low level and when the clock signal CLK is at a high level.

The switching transistor M93 has a first terminal to which an output signal of the third latch 210 is applied, and a second terminal connected to an input terminal of the ninth inverter 221. The inverse clock signal CLKB is applied to a gate terminal of the switching transistor M93, and the output signal of the third latch 210 is applied to the ninth inverter 221 when the inverse clock signal CLKB is at a low level.

The ninth and tenth inverters 221 and 222 each output an inverted signal of an applied input signal.

The switching transistor M94 has a first terminal connected to an output terminal of the tenth inverter 222, and a second terminal connected to the input terminal of the ninth inverter 221. The clock signal CLK is applied to a gate terminal of the switching transistor M94, and an output signal of the tenth inverter 222 is applied to the input terminal of the ninth inverter 221 when the clock signal CLK is at a low level. Also, an output signal of the ninth inverter 221 is applied to a scanning line as an output signal (out) of the entire scan stage.

As described above, the scan driver according to the above described embodiments of the present invention includes a plurality of scan stages, and a plurality of input signal select circuits each including two transistors and each being located between adjacent scan stages. Accordingly, the scan driver may perform both progressive scanning and interlaced scanning. Also, each scan stage may be realized by any circuit described above.

Figure 12:
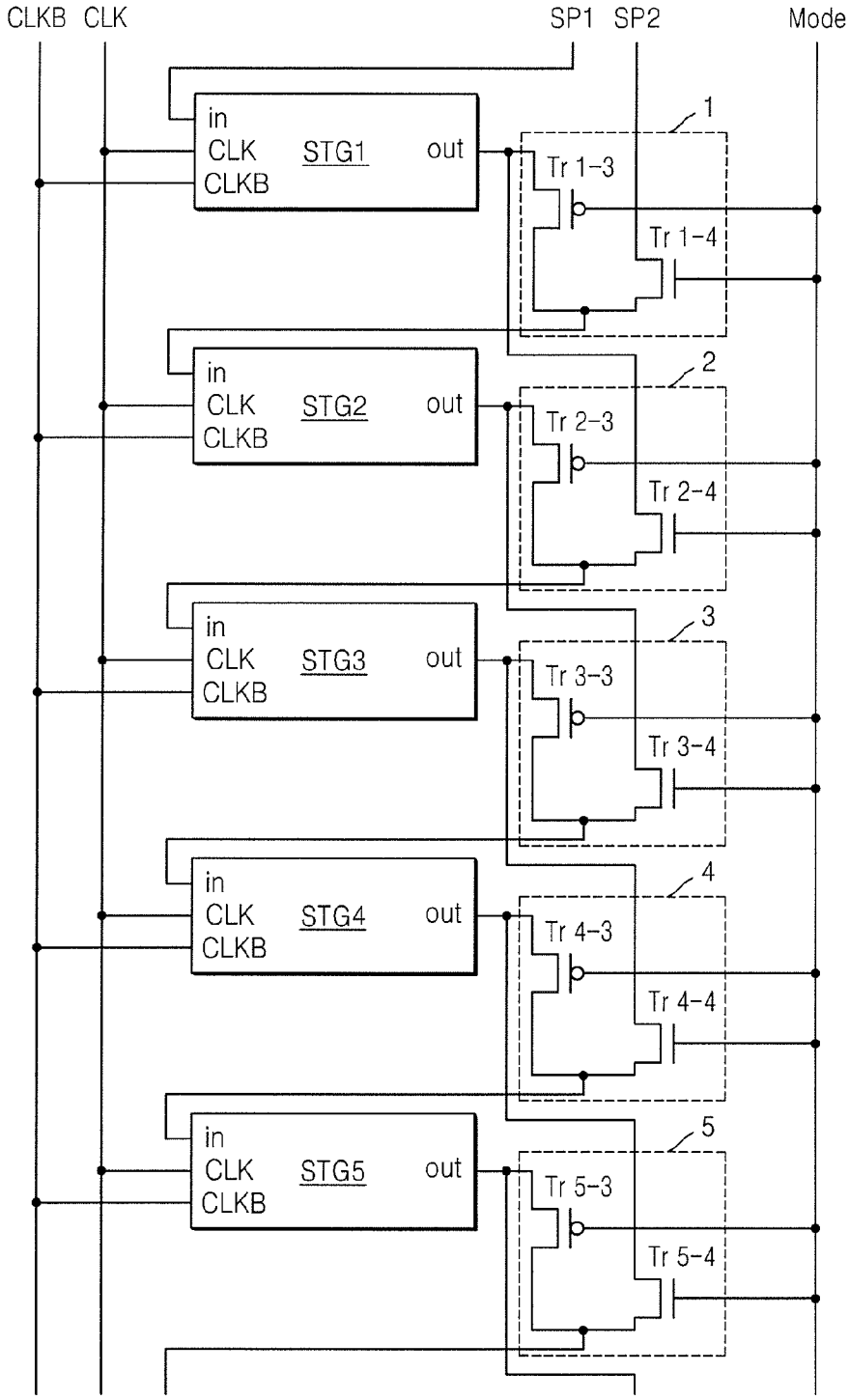
FIG. 12 is a circuit diagram of a scan driver for both progressive scanning and interlaced scanning, according to another embodiment of the present invention.

FIG. 12 is a block diagram of a scan driver for both progressive scanning and interlaced scanning, according to another embodiment of the present invention.

Referring to FIG. 12, the scan driver according to an embodiment of the present invention includes a plurality of scan stages STG1 through STGn and a plurality of input signal select circuits 1 through n-1, like the scan driver of FIG. 1.

A difference between the scan drivers of FIGS. 1 and 12 is that the plurality of input signal select circuits 1 through n-1 of the scan driver in FIG. 12 each include transistors having different channel types. For example, first transistors Tr1-3 through Tr(n-1)-3 are PMOS transistors, and second transistors Tr1-4 through Tr(n-1)-4 are NMOS transistors.

When the input signal select circuits 1 through n-1 are configured as described above, a first mode signal PROG and a second mode signal INTER may have the same logic level value. Also, the first mode signal PROG and the second mode signal INTER are not separately applied, but a common mode signal MODE is applied from one signal line so as to control switching operations of the first transistors Tr1-3 through Tr(n-1)-3 and the second transistors Tr1-4 through Tr(n-1)-4. In a progressive scanning method, the common mode signal MODE is at a low level; and in an interlaced scanning method, the common mode signal MODE is at a high level.

However, the channel types of the first transistors Tr1-3 through Tr(n-1)-3 and the second transistors Tr1-4 through Tr(n-1)-4 are not limited to the types described above. In other words, the first transistors Tr1-3 through Tr(n-1)-3 may be NMOS transistors, and the second transistors Tr1-4 through Tr(n-1)-4 may be PMOS transistors. In this case, in the progressive scanning method, the common mode signal MODE is at a high level; and in the interlaced scanning method, the common mode signal MODE is at a low level.

Accordingly, the scan driver according to the embodiment of FIG. 12 performs both progressive scanning and interlaced scanning by including two transistors between each scan stage. Also, one less control signal may be used, compared to the scan driver of FIG. 1.

Figure 13:
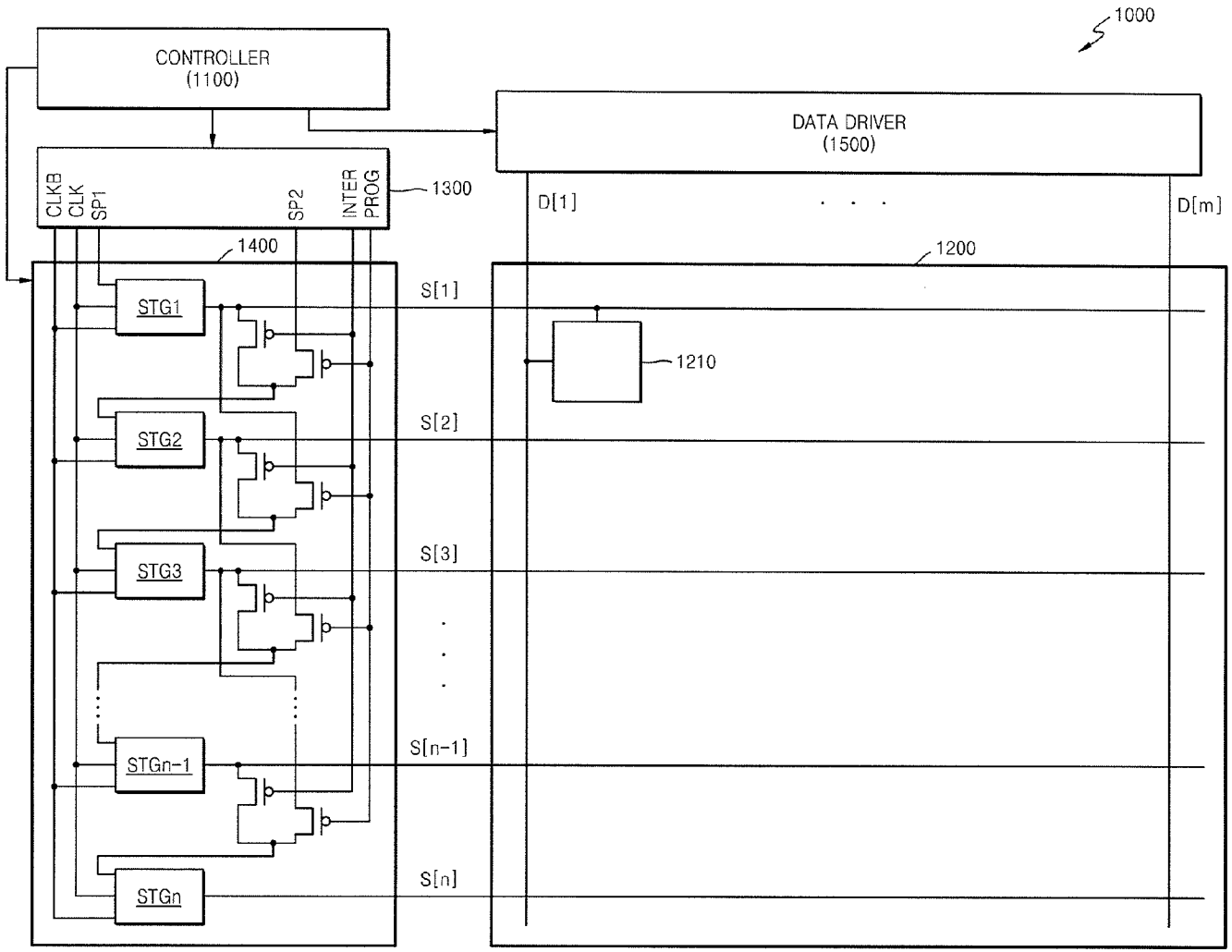
FIG. 13 is a block diagram of a flat panel display apparatus including a scan driver for both progressive scanning and interlaced scanning, according to an embodiment of the present invention.

FIG. 13 is a block diagram of a flat panel display apparatus 1000 including a scan driver 1400 for both progressive scanning and interlaced scanning, according to an embodiment of the present invention.

Referring to FIG. 13, the flat panel display apparatus 1000 includes a controller 1100, a display unit 1200, a signal generator 1300, a scan driver 1400, and a data driver 1500.

The controller 1100 controls operations of each element of the flat panel display apparatus 1000. The controller 1100 determines whether the flat panel display apparatus 1000 is to operate in a progressive scanning method or in an interlaced scanning method, and controls the operations accordingly.

The display unit 1200 includes n×m pixel circuits 1210 arranged in a matrix form, n scanning lines S[1] through S[n] extending in a row direction, and m data lines D[1] through D[m] extending in a column direction, where n and m are natural numbers. Also, although not illustrated in FIG. 13, a power supply line for applying power to the pixel circuits 1210 may be formed. The pixel circuits 1210 are respectively formed at crossing regions between the scanning lines S[1] through S[n] and the data lines D[1] through D[m].

Each of the plurality of pixel circuits 1210 may be a pixel circuit for an organic light emitting diode (OLED) display apparatus, wherein the pixel circuit includes an OLED. However, the pixel circuits 1210 are not limited thereto, and may be pixel circuits for a liquid crystal display apparatus.

The scanning lines S[1] through S[n] transmit scan signals to the pixel circuits 1210. Also, the data lines D[1] through D[m] transmit data signals to the pixel circuits 1210.

The signal generator 1300 generates various control signals so that the scan driver 1400 operates in the progressive or interlaced scanning method, according to the control signals of the controller 1100. Examples of the control signals include a clock signal CLK, an inverse clock signal CLKB, a first scan start signal SP1, a second scan start signal SP2, and a first mode signal PROG and a second mode signal INTER, which are mode select signals.

The scan driver 1400 supplies a scan signal to the scanning lines S[1] through S[n] according to the control signals generated by the signal generator 1300. When the scan driver 1400 operates according to the progressive scanning method, the scan signal is sequentially applied to the scanning lines S[1] through S[n], and the data signal is applied to the pixel circuit 1210 according to the scan signal. When the scan driver 1400 operates according to the interlaced scanning method, the scan signal is first sequentially applied to odd scanning lines S[1] through S[n-1]. When a scanning operation of the odd scanning lines S[1] through S[n-1] is completed, a scanning operation of even scanning lines S[2] through S[n] is continuously performed, and thus the scan signal is sequentially applied to the even scanning lines S[2] through S[n].

The scan driver 1400 may operate according to the circuits and timing diagrams illustrated in FIGS. 1 through 10, and detailed descriptions thereof will not be repeated.

The data driver 1500 applies data signals to the data lines D[1] through D[m]. The data signals may be output from a voltage or current supply source in the data driver 1500.

Accordingly, a flat panel display apparatus including a scan driver for performing both progressive scanning and interlaced scanning may be conveniently provided by a plurality of input signal select circuits each including two transistors between a plurality of scan stages included in the scan driver.

As described above, one scan driver can be used for both progressive scanning and interlaced scanning without providing a separate scan driver according to a scanning method.

The embodiments of the present invention may be embodied in computer programs and may be implemented in general-purpose digital computers that execute the programs stored in a computer readable recording medium. Examples of the computer readable recording medium include magnetic storage media (e.g., ROM, floppy disks, hard disks, etc.), optical recording media (e.g., CD-ROMs or DVDs), and other suitable storage media.

While the present invention has been particularly shown and described with reference to exemplary embodiments thereof, it will be understood by those of ordinary skill in the art that various changes in form and details may be made therein without departing from the spirit and scope of the present invention as defined by the following claims and equivalent thereof.

What is claimed is:

1. A scan driver comprising:

a plurality of scan stages, each of the scan stages for generating an output signal according to a clock signal and an input signal; and a plurality of input signal select circuits, at least one of the input signal select circuits being configured to select between one signal from the output signal of one of the scan stages from one stage before and the output signal of another one of the scan stages from two stages before, according to a mode select signal, wherein the mode select signal comprises a first mode signal and a second mode signal, and wherein the at least one of the plurality of input signal select circuits comprises:

a first transistor coupled between an output terminal of the one of the scan stages from one stage before and an input terminal of a current one of the scan stages, and being configured to perform a switching operation according to the first mode signal; and a second transistor coupled between an output terminal of the another one of the scan stages from two stages before and the input terminal of the current scan stage, and being configured to perform a switching operation according to the second mode signal.

2. The scan driver of claim 1, wherein logic levels of the first and second mode signals are different from each other.

3. The scan driver of claim 2, wherein channel types of the first transistor and the second transistor are different from each other.

4. The scan driver of claim 1, wherein the first mode signal and the second mode signal are the same.

5. The scan driver of claim 4, wherein channel types of the first transistor and the second transistor are the same.

6. The scan driver of claim 1, wherein, during a progressive scanning operation, the first transistor is turned on and the second transistor is turned off.

7. The scan driver of claim 1, wherein, during an interlaced scanning operation, the first transistor is turned off and the second transistor is turned on.

8. The scan driver of claim 1, wherein each of the plurality of scan stages samples the input signal at a falling edge of the clock signal and outputs the sampled input signal as the output signal at a rising edge of the clock signal.

9. The scan driver of claim 8, wherein each of the plurality of scan stages comprises a flip-flop having a master-slave structure.

10. The scan driver of claim 8, wherein the output signal is output for one cycle of the clock signal.

11. The scan driver of claim 1, wherein each of the plurality of scan stages comprises:

a first signal processor for generating a first output signal in response to receiving the clock signal, the input signal, and an inverse input signal;

a second signal processor for generating a second output signal in response to receiving the first output signal, an inverse clock signal, and a first negative feedback signal;

a third signal processor for generating a third output signal in response to receiving the second output signal;

a fourth signal processor for generating a fourth output signal in response to receiving the second output signal, the third output signal, and the inverse clock signal;

a fifth signal processor for generating a fifth output signal in response to receiving the fourth output signal, the clock signal, and a second negative feedback signal; and a sixth signal processor for generating the output signal in response to receiving the fifth output signal.

12. The scan driver of claim 11, wherein the first negative feedback signal is the third output signal, and the second negative feedback signal is the output signal.

13. The scan driver of claim 11, wherein the fifth output signal is an inverse output signal of a corresponding one of the scan stages.

14. The scan driver of claim 11, wherein the first signal processor comprises:

a first transistor for switching a first power voltage according to the clock signal;

a second transistor for supplying the first power voltage from the first transistor as the first output signal when the input signal is applied to a control terminal of the second transistor;

a third transistor for blocking a second power voltage from being supplied as the first output signal when the input signal is applied to a control terminal of the third transistor;

a first capacitor having a first terminal coupled to a first terminal of the third transistor, and a second terminal coupled to a second terminal of the third transistor;

a fourth transistor for supplying the second power voltage as the first output signal, a control terminal of the fourth transistor being coupled to the first terminal of the third transistor;

a fifth transistor for transferring the second power voltage to the control terminal of the fourth transistor when the inverse input signal is applied to a control terminal of the fifth transistor; and a sixth transistor for transferring the second power voltage to the fourth transistor according to the clock signal.

15. The scan driver of claim 11, wherein the second signal processor comprises:

a seventh transistor for switching a first power voltage according to the inverse clock signal;

an eighth transistor for supplying the first power voltage from the seventh transistor as the second output signal when the first negative feedback signal is applied to a control terminal of the eighth transistor;

a ninth transistor for blocking a second power voltage from being supplied as the second output signal when the first negative feedback signal is applied to a control terminal of the ninth transistor;

a second capacitor having a first terminal coupled to a first terminal of the ninth transistor, and a second terminal coupled to a second terminal of the ninth transistor;

a tenth transistor for supplying the second power voltage as the second output signal, a first terminal of the tenth transistor being coupled to the first terminal of the ninth transistor;

an eleventh transistor for transferring the second power voltage to a control terminal of the tenth transistor when the first output signal is applied to a control terminal of the eleventh transistor; and a twelfth transistor for transferring the second power voltage to the tenth transistor according to the inverse clock signal.

16. The scan driver of claim 11, wherein the third signal processor comprises:

a thirteenth transistor for switching a first power voltage according to the second output signal;

a fourteenth transistor for receiving a second power voltage and supplying the received second power voltage as the third output signal;

a third capacitor having a first terminal coupled to a control terminal of an eighth transistor and a control terminal of a ninth transistor, and a second terminal coupled to a control terminal of the fourteenth transistor; and a fifteenth transistor having a control terminal to which the second power voltage is applied, and for transferring the second power voltage to the fourteenth transistor.

17. The scan driver of claim 11, wherein the fourth signal processor comprises:

a sixteenth transistor for switching a first power voltage according to the inverse clock signal;

a seventeenth transistor for supplying the first power voltage from the sixteenth transistor as the fourth output signal when the third output signal is applied to a control terminal of the seventeenth transistor;

an eighteenth transistor for blocking a second power voltage from being supplied as the fourth output signal when the third output signal is applied to a control terminal of the eighteenth transistor;

a fourth capacitor having a first terminal coupled to a first terminal of the eighteenth transistor and a second terminal coupled to a second terminal of the eighteenth transistor;

a nineteenth transistor for supplying the second power voltage as the fourth output signal, a control terminal of the nineteenth transistor being coupled to the first terminal of the eighteenth transistor;

a twentieth transistor for transferring the second power voltage to the control terminal of the nineteenth transistor when the second output signal is applied to a control terminal of the twentieth transistor; and a twenty-first transistor for transferring the second power voltage to the nineteenth transistor according to the inverse clock signal.

18. The scan driver of claim 11, wherein the fifth signal processor comprises:

a twenty-second transistor for switching a first power voltage according to the clock signal;

a twenty-third transistor for transferring the first power voltage to a twenty-fifth transistor when the second negative feedback signal is applied to a control terminal of the twenty-third transistor;

a twenty-fourth transistor having a control terminal to which the second negative feedback signal is applied, and being configured to diode-connect the twenty-fifth transistor;

a fifth capacitor having a first terminal coupled to a first terminal of the twenty-fourth transistor, and a second terminal coupled to a second terminal of the twenty-fourth transistor;

a twenty-fifth transistor having a first terminal coupled to the second terminal of the twenty-fourth transistor, and a control terminal coupled to the first terminal of the twenty-fourth transistor;

a twenty-sixth transistor for transferring a second power voltage to the control terminal of the twenty-fifth transistor when the fourth output signal is applied to a control terminal of the twenty-sixth transistor; and a twenty-seventh transistor for transferring the second power voltage to the twenty-fifth transistor according to the clock signal.

19. The scan driver of claim 11, wherein the sixth signal processor comprises:

a twenty-eighth transistor for switching a first power voltage according to the fifth output signal;

a twenty-ninth transistor for receiving a second power voltage and supplying the received second power voltage as the output signal;

a sixth capacitor having a first terminal coupled to a control terminal of a twenty-third transistor and a control terminal of a twenty-fourth transistor, and a second terminal coupled to a control terminal of the twenty-ninth transistor; and a thirtieth transistor having a control terminal to which the second power voltage is applied, and for transferring the second power voltage to the twenty-ninth transistor.

20. A flat panel display apparatus comprising:

a scan driver for supplying a scan signal to a plurality of scanning lines;

a data driver for supplying a data signal to a plurality of data lines;

a signal generator for generating a clock signal and a mode select signal, and applying the generated clock signal and mode select signal to the scan driver; and a display unit comprising a plurality of pixel circuits at crossing regions between the plurality of scanning lines and the plurality of data lines, wherein the scan driver comprises:

a plurality of scan stages, each of the scan stages for generating an output signal according to the clock signal and an input signal; and a plurality of input signal select circuits, at least one of the input signal select circuits being configured to select between one signal from the output signal of one of the scan stages from one stage before and the output signal of another one of the scan stages from two stages before, according to the mode select signal.

21. The flat panel display apparatus of claim 20, further comprising a controller for controlling the signal generator so that the flat panel display apparatus is operated according to a progressive scanning method or an interlaced scanning method.

22. The flat panel display apparatus of claim 20, wherein the mode select signal comprises a first mode signal and a second mode signal, and the at least one of the plurality of input signal select circuits comprises:

a first transistor coupled between an output terminal of the one of the scan stages from one stage before and an input terminal of a current one of the scan stages, and being configured to perform a switching operation according to the first mode signal; and a second transistor coupled between an output terminal of the another one of the scan stages from two stages before and the input terminal of the current one of the scan stages, and being configured to perform a switching operation according to the second mode signal.

23. The flat panel display apparatus of claim 22, wherein logic levels of the first mode signal and the second mode signal are different from each other.

24. The flat panel display apparatus of claim 23, wherein channel types of the first transistor and the second transistor are different from each other.

25. The flat panel display apparatus of claim 22, wherein the first mode signal and the second mode signal are the same.

26. The flat panel display apparatus of claim 25, wherein channel types of the first transistor and the second transistor are the same.

27. The flat panel display apparatus of claim 22, wherein, during a progressive scanning operation, the first transistor is turned on and the second transistor is turned off.

28. The flat panel display apparatus of claim 22, wherein, during an interlaced scanning operation, the first transistor is turned off and the second transistor is turned on.

29. The flat panel display apparatus of claim 20, the flat panel display apparatus is an organic light emitting display apparatus.

* * * * *